US006471829B2

(12) United States Patent
Frawley, Jr. et al.

(10) Patent No.: US 6,471,829 B2
(45) Date of Patent: Oct. 29, 2002

(54) VARIABLE FREQUENCY FOURDRINIER GRAVITY FOIL BOX

(75) Inventors: Thomas E. Frawley, Jr., Appleton, WI (US); Mark R. VanRens, DePere, WI (US); Alan Wouters, Appleton, WI (US); Patrick J. Theut, Tomahawk, WI (US)

(73) Assignee: Appleton International, Inc., Kimberly, WI (US)

( * ) Notice: Subject to any disclaimer, the term of this patent is extended or adjusted under 35 U.S.C. 154(b) by 0 days.

(21) Appl. No.: 09/972,144

(22) Filed: Oct. 5, 2001

(65) Prior Publication Data

US 2002/0067544 A1 Jun. 6, 2002

Related U.S. Application Data

(60) Provisional application No. 60/238,930, filed on Oct. 10, 2000.

(51) Int. Cl.[7] ..... D21F 1/54

(52) U.S. Cl. ..... 162/352; 162/354; 162/374; 162/208; 162/211

(58) Field of Search ..... 162/352, 354, 162/374, 208, 211

(56) References Cited

U.S. PATENT DOCUMENTS

| | | | | |
|---|---|---|---|---|
| 3,027,941 | A | 4/1962 | Dunlap | 162/352 |
| 3,535,201 | A | 10/1970 | Reynolds et al. | 162/352 |
| 3,762,991 | A | 10/1973 | Justus | 162/352 |
| 3,934,996 | A | 1/1976 | Frank | 65/106 |
| 4,055,460 | A | 10/1977 | Buchanan | 162/209 |

(List continued on next page.)

OTHER PUBLICATIONS

Bell, Norman E., Optimal Forming Zone Design is Key to Superior Sheet Characteristics, *Pulp & Paper,* pp. 157–164, Sep., 1992, 6 pages.

Paper Trade Associates, Wet–End Structures, http://paper-tradeassoc.com/p506.htm (2000), (1 page).

PowerTrax, Linear Systems & Components, http://www.nookindustries.com/productsummary/powertrax.cfm, 3 pages.

PowerTrac, Rolled & Precision Ground Ball Screws & Ball Splines, http://www.nookindustries.com/productsummary/powertrac.cfm, 5 pages.

Universal Thread Grinding Company, Precision Lead Screw Assemblies, http://www.thomasregister.com/olc/utg/plsa2.htm (2001), 3 pages.

GMS Ball Co. Ltd., GMS Ball Screw, http://www.gms-ball.co.uk, 1 page.

Precision Screw Thread Corp., Lead Screws in Business Machine, http://www.precisionscrewthread.com/leadscrew.html (1999), 2 pages.

ActionJac™, Worm Gear Screw Jacks, http://www.nookindustries.com/productsummary/actionjac_gear.cfm, 4 pages.

ActionJac™, electric Cylinder Actuators, http://www.nookindustries.com/productsummary/actionjac_cylinder.cfm, 1 page.

BSA, Products, Linear Actuators, Ball Screws, Rails & Bearings, www.ballscrews.com/html/misc/products.html, 10 pages.

*Primary Examiner*—Karen M. Hastings
(74) *Attorney, Agent, or Firm*—Whyte Hirschboeck Dudek SC

(57) ABSTRACT

A variable frequency foil (VFF) box assembly and mechanisms for moving individual foils/foil beams and individual foil beam sets relative to each other to adjust the frequency of a paper making machine, and method of use are provided. The VFF box assembly allows for continuously and uniformly adjusting the pitch distances of individual foils within foil sets over a finite range, and also adjusting the distance between foil sets during the continuous operation of a paper making machine.

48 Claims, 13 Drawing Sheets

U.S. PATENT DOCUMENTS

| | | | | | |
|---|---|---|---|---|---|
| 4,162,937 | A | | 7/1979 | Corbellini | 162/352 |
| 4,261,498 | A | | 4/1981 | Short | 226/3 |
| 4,306,934 | A | | 12/1981 | Seppanen | 162/209 |
| 4,321,108 | A | | 3/1982 | Goddard et al. | 162/272 |
| 4,331,511 | A | | 5/1982 | Goddard et al. | 162/352 |
| 4,443,298 | A | | 4/1984 | Thorp | 162/252 |
| 4,684,441 | A | | 8/1987 | Ibrahim | 162/198 |
| 5,011,577 | A | | 4/1991 | Hansen et al. | 162/352 |
| 5,074,964 | A | | 12/1991 | Partanen | 162/203 |
| 5,116,477 | A | * | 5/1992 | Bubik et al. | 162/352 |
| 5,169,500 | A | | 12/1992 | Mejdell | 162/352 |
| 5,262,010 | A | | 11/1993 | Bubik et al. | 162/352 |
| 5,314,581 | A | | 5/1994 | Lin et al. | 162/263 |
| 5,421,961 | A | | 6/1995 | Miller | 162/252 |
| 5,437,769 | A | | 8/1995 | Bando et al. | 162/301 |
| 5,556,509 | A | | 9/1996 | Trokhan et al. | 162/111 |
| 5,630,910 | A | | 5/1997 | McPherson | 162/352 |
| 5,681,430 | A | | 10/1997 | Neun et al. | 162/355 |
| 5,932,072 | A | | 8/1999 | Neun et al. | 162/352 |

* cited by examiner

VARIABLE FREQUENCY FOURDRINIER GRAVITY FOIL BOX

CROSS-REFERENCE TO RELATED APPLICATIONS

This application claims the benefit of U.S. Provisional Application Ser. No. 60/238,930, filed Oct. 10, 2000.

FIELD OF THE INVENTION

The present invention relates to an apparatus and system for altering the frequency of a Fourdrinier table in the formation of a continuous web of paper or other material.

BACKGROUND OF THE INVENTION

In the manufacture of paper, a stock of fibers and mineral fillers suspended in water, is deposited onto the moving wire on the Fourdrinier table of a paper machine. An example of a conventional Fourdrinier table assembly 10 is shown in FIG. 1. The table 10 includes a head box 12 from which a stock suspension is deposited onto a continuously moving wire 14, a breast roll 16, forming unit 18, and a series of gravity foil boxes 20 and vacuum foil boxes 22, a dandy roll 24, a series of suction boxes 26, and a couch roll 28. As the stock suspension moves along the wire 14 and over the foil boxes 20, 22 and suction boxes 26, the water is removed to form a continuous web.

Many theories have been applied to enhance water removal and achieve proper fiber orientation and distribution to form the fiber sheet, but with varying degrees of success. In one practice, table rolls have been used to apply a vacuum pulse by drawing water from the undersurface of the wire, and then create a pressure pulse by pushing water through the fabric to agitate the stock suspension for proper fiber orientation. However, as production speeds increased and higher vacuum forces were applied, excessive jumping of the stock of the forming sheet occurred which adversely affected formation quality. With the development of hydrofoils, control of water removal and formation improved.

From 1960 to 1970, machines became faster and wider, and the gravity foil box was introduced. The device consisted of a bridge-like framework that spanned the table with "T" bars installed for the individual blades. Foil blades could be removed or added on the run, and the spacing of the "foil banks" was random at best. The concept of foil angle was then proposed and experimentation was performed to determine optimal foil blade angle and foil bank spacing on the machine, which are important to drainage and formation.

A subsequent development was the concept of table harmonics, an engineering principle stating that the energy contained within the stock at the exit of the head box can be amplified (for improved drainage and formation) by the spacing of the foils. The harmonic excitation of the stock can be further altered by placing foil banks at specific intervals along the table based on the tip-to-tip spacing of the foils within each bank. This principle gave rise to the practice of placing the start of a first foil bank in the vicinity of three to six feet from the exit of the head box. It was also learned that the ability to add or remove foils from a bank significantly impacted sheet properties. However, foil banks could not be moved while the machine was running due to the tremendous drag imparted onto the foils.

In about 1978, the concept of table frequency was combined with table harmonics to maximize drainage and formation. It was discovered that packing a table with foils spaced an appropriate distance apart, and then removing the foils from the table in strategic locations, achieved the desired Fourdrinier frequency when operating at higher speeds, up to 3300 fpm and higher.

Another development included the introduction of an automated foil bank that varied the pitch of the foil blade (the variable angle foil) to impact drainage and formation. It was also determined that the best formation and drainage for any given table was a frequency between 55 Hz and 105 Hz. In addition, a foil bank system was introduced that could raise foils into the wire and/or drop them from contact with the wire, but only allowed the use of a finite number of frequencies (i.e., either 55 or 75 Hz) by the papermaker. This limits the success of the papermaker where another frequency (i.e., 61 Hz) would be optimal for formation and drainage.

The function of the Fourdrinier table is two-fold: (1) to de-water the stock utilizing the effects of both gravity and applied vacuum, and (2) to subject the stock to periodic excitation as the wire passes over a series of inverted continuous hydrofoil blades (foils) that extend transversely across the table in a cross machine direction, i.e., at a right angle to the direction in which the wire travels.

Traditionally, a Fourdrinier table include several sections of foil groupings, or sets, of approximately six foils each, that are mounted on individual foil support beam structures (i.e., T-bar mounts) spaced along the length of the table at set intervals to create a desired pulse frequency. The foil sets are normally affixed to a sub-structure of the table commonly referred to as a "box." An example of a conventional foil box 30 having four foils 34 is shown in FIG. 2. The direction of the movement of the wire (not shown) over the foils 34 is shown by arrow 30. The boxes are further sub-classified into either gravity boxes 20 or vacuum boxes 22 (FIG. 1). The first several foil sets aid in de-watering the stock under the influence of gravity. Further down the table as the water content of the stock decreases, a vacuum is applied from beneath the wire to facilitate the de-watering process.

The foils aid in the de-watering process and also impart a pressure impulse to the stock suspension. The impulses serve to keep the fibers and fillers in suspension during the de-watering process yielding a paper stock of uniform consistency. A single pulse is not adequate to control the stock on the Fourdrinier table. Rather, a series of pulses is generated and repeated at a standard interval.

The frequency of these impulses is referred to as the Fourdrinier frequency, which is defined as the velocity of the wire (in inches-per-second) divided by the pitch distance between the foils (in inches). It is well known to those versed in the art/science of papermaking that the frequency of these impulses has a dramatic effect upon the formation of the paper fibers. Under most circumstances, acceptable formation occurs at a Fourdrinier frequency between about 55 hertz and about 90 hertz. However, the current state of the art/science of paper formation relies upon the strategic use of conventional foil blades, multi-pulse foils, and/or foil boards that compromise effective stock de-watering with appropriate stock excitation frequencies.

SUMMARY OF THE INVENTION

The present invention provides variable frequency foil (VFF) box assemblies and mechanisms for moving individual foils/foil beams and individual foil beam sets relative to each other to adjust the frequency of a paper making machine independent of the wire speed. The invention allows for continuously and uniformly adjusting the pitch distances of individual foils within foil sets over a finite range, and also adjusting the distance between foil sets during the operation of a paper making machine.

In one aspect, the invention provides a foil beam assembly. In one embodiment, the foil beam assembly comprises at least a first and a second foil beam set, each foil beam set comprising a leading foil beam, a trailing foil beam, and at least one intermediate foil beam disposed therebetween, and a mechanism to laterally move the foil beams and the foil sets relative to each other. The mechanism is connected to each of the foil beams and to the first and second foil beam set. The mechanism is operable to laterally move the foil beams to alter the pitch distance such that each of the foil beams are spaced apart by a standard interval, and to laterally move at least one of the foil beam sets to alter the distance therebetween such that the foil beam sets are spaced apart by an integer multiple of the standard interval.

In one embodiment of the foil beam assembly, the mechanism can comprise a mating screw and nut assembly affixed to a first foil beam and an adjacent second foil beam, and in rotatable contact with a gear mounted on a shaft, whereby rotating the shaft causes lateral movement of at least the second foil beam to alter the pitch distance between the first and second foil beams. In another embodiment, the mechanism of the foil beam assembly comprises a hydraulic or pneumatic device mounted on the first and second foil beams and operable to laterally move at least the second foil beam relative to the first foil beam. In another embodiment of the foil beam assembly, the mechanism can comprise an activating screw and nut assembly affixed to the second foil beam and oriented perpendicular to the foil beams, the activating screw connected to an actuating device operable to move the activating screw to laterally move the second foil beam relative to the first foil beam. In yet another embodiment, the mechanism of the foil beam assembly can comprise nut members mounted on a surface of the first and second foil beams, and activating screw members engaged through the nut members and extending perpendicular to the foil beams, the activating screw members connected to actuators comprising a worm/gear assembly mounted on a drive shaft, wherein movement of the actuators move the activating screw members which laterally move at least the second foil beam relative to the first foil beam. Yet another embodiment of a mechanism for use in the foil beam assembly comprises a pantograph assembly connected to the first and second foil beams, wherein extension and retraction of the pantograph moves at least the second foil beam relative to the first foil beam to alter the pitch distance therebetween. A further embodiment of the mechanism of the foil beam assembly comprises a telescoping shaft assembly.

In another aspect, the invention provides a method of varying the frequency of a foil beam set. In one embodiment, the method comprises the steps of providing at least a first and second foil beam set, each set comprising two or more foil beams mounted on a support structure, and a mechanism interconnecting the foil beams and the foil beam sets, the mechanism structured to laterally move the foil beams relative to each other and to laterally move the foil beam sets relative to each other; and actuating the mechanism to laterally move the foil beams to alter the distance therebetween and maintain the foil beams at a distance X relative to each other, and to laterally move the foil beam sets relative to each other to a distance as an integer multiple of the distance X, wherein the combined frequency of the foil beam sets is maintained at about 50 to about 90 hertz.

BRIEF DESCRIPTION OF THE DRAWINGS

Preferred embodiments of the invention are described below with reference to the following accompanying drawings, which are for illustrative purposes only. Throughout the following views, the reference numerals will be used in the drawings, and the same reference numerals will be used throughout the several views and in the description to indicate same or like parts.

FIG. 8A is a top perspective view of the variable frequency foil box. FIG. 8B is a bottom plan view of the variable frequency box of FIG. 8A, taken along lines A—A, and showing the attachment of the foil support beams to the center points of the underlying pantograph assembly. FIG. 8C is a side elevational view of the variable frequency box of FIG. 8B, taken along lines B—B.

DETAILED DESCRIPTION OF THE INVENTION

The present invention relates to mechanisms and methods for varying the frequency of a Fourdrinier table, independent of the wire speed, by continuously and uniformly adjusting the pitch distances of individual foils within foil sets over a finite range, and also adjusting the distance between foil sets (boxes). The mechanisms of the invention can be used in gravity box sections of the infeed end of a paper machine Fourdrinier table, among other applications. The invention will be described generally with reference to the drawings for the purpose of illustrating the present preferred embodiments only and not for purposes of limiting the same.

Figure 1:
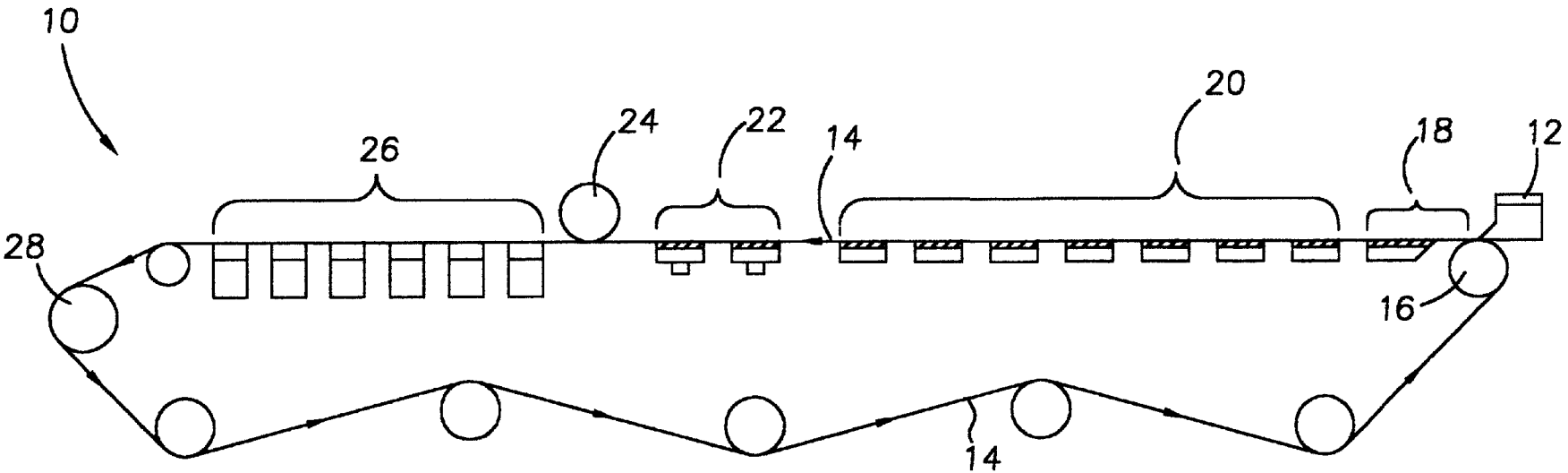
FIG. 1 PRIOR ART
FIG. 1 is an illustration of a conventional Fourdrinier table assembly.
Figure 2:
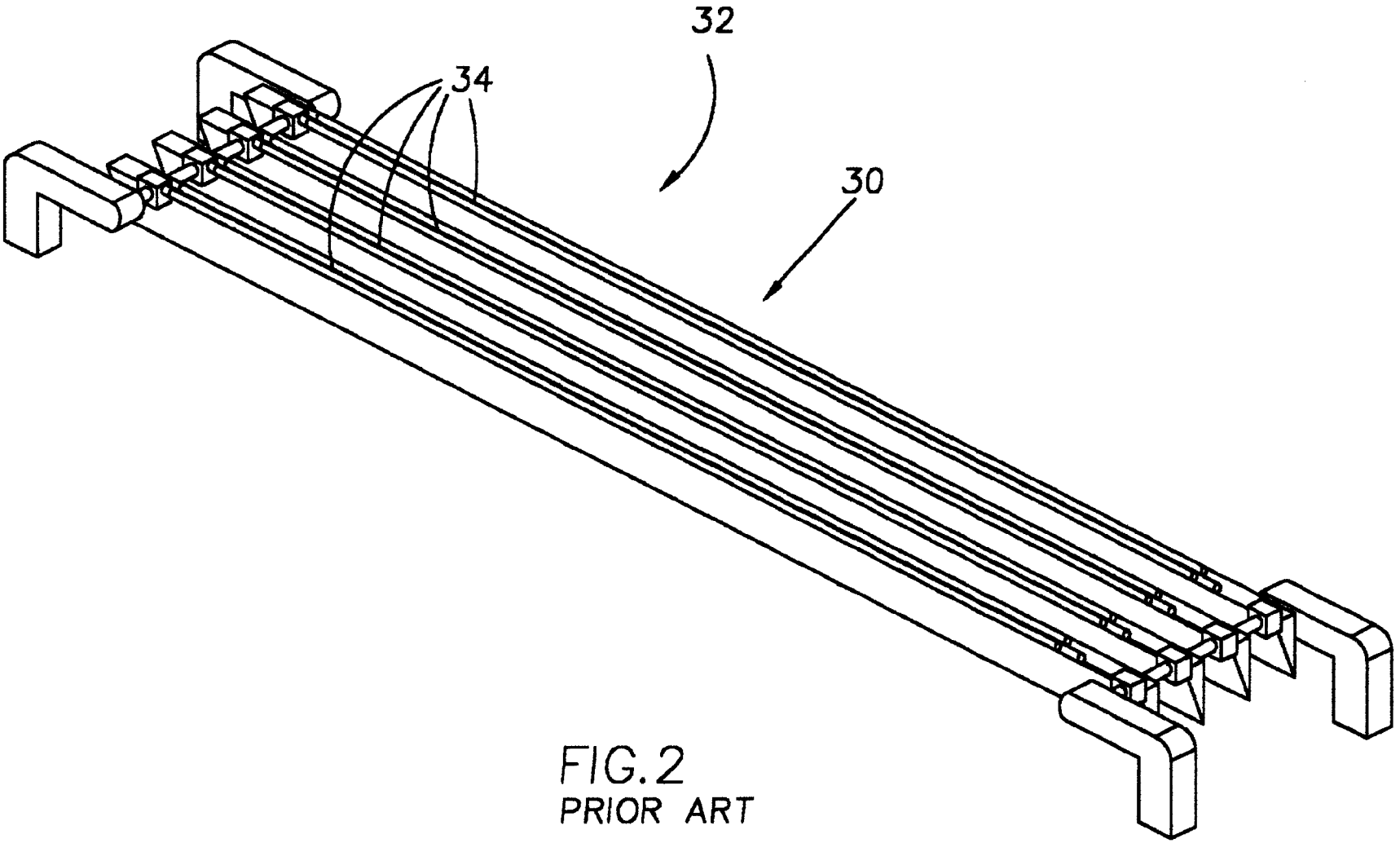
FIG. 2 PRIOR ART
FIG. 2 is a perspective view of a conventional foil box having four foils.
Figure 3:
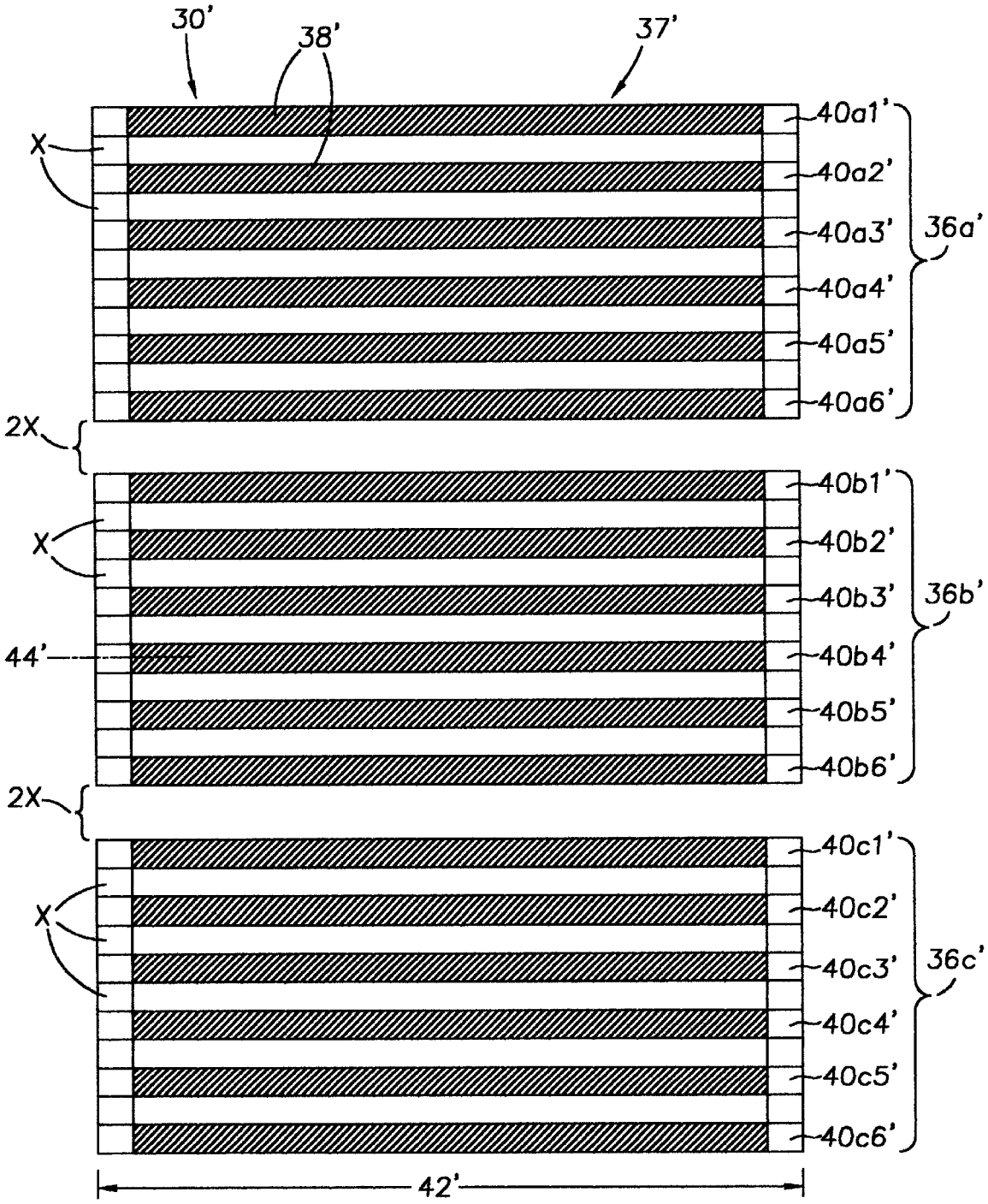
FIG. 3 is a schematic top plan view of an embodiment of an assembly of variable frequency foil boxes according to the invention comprising a series of three foil sets (boxes), each foil set having six foils.

An assembly 37' comprising three variable frequency foil (VFF) boxes ("foil sets") 36*a*', 36*b*', 36*c*' for use in a Fourdrinier table, is illustrated in FIG. 3. As typical, each VFF foil set 36*a*'–36*c*' incorporates up to six foils 38' (38'*a–c*, 1–6) affixed to individual foil support beam structures 40' (40'*a–c*, 1–6), although an individual foil set can comprise more or less foils as desired. The width 42' of the foil boxes 36*a*'–36*c*' corresponds to the width of the paper making machine. The foil support beams 40' are mounted so as to prevent movement along their respective centerlines 44', and to provide free movement along an axis perpendicular to their respective centerlines.

Utilizing a mechanism according to the invention, the frequency of an individual foil box or set 36*a*'–36*c*' ("box frequency") is infinitely adjustable over a finite range by altering the pitch distance between the foil blades 38' within a foil set such that all the foils remain substantially equally spaced at a distance "X" throughout the adjustment range. According to the invention, in addition to maintaining a spacing of "X" between the foils/foil beams within a single foil set 36*a*'–36*c*' the relative distance between adjacent foil sets is also maintained at a standard interval (e.g., the foil spacing distance "X") or an integer multiple of that standard interval to sustain the desired frequency of the Fourdrinier table as a whole ("table frequency" or "Fourdrinier frequency"). For example, referring to foil sets 36*a*' and 36*b*', if the standard interval between foil support beams 40*a*1'–40*a*6' is X-inch (e.g., 5 ¼-inch), then the distance between the last (trailing) foil beam 40*a*6' on the first foil set 36*a*' and the leading foil beam 40*b*1' on the next (second) foil set 36*b*' would be either 1X, 2X, 3X-inch, etc. (5¼, 10½, 15¾-inch, etc.), and the distance between the last (trailing) foil beam 40*a*6' on the second foil set 36*a*' to the leading foil beam 40*c*1' on the next (third) foil set 36*c*' would also be either 1X, 2X, 3X-inch etc. (5¼, 10½, 15¾-inch, etc.), and so forth. This is accomplished by altering the distances between adjacent foil sets (36*a*' to 36*b*', 36*b*' to 36*c*') utilizing a mechanism according to the invention. As depicted in FIG. 3, the standard interval between foils is "X", and the distance between foil sets is "2X".

Figure 4:
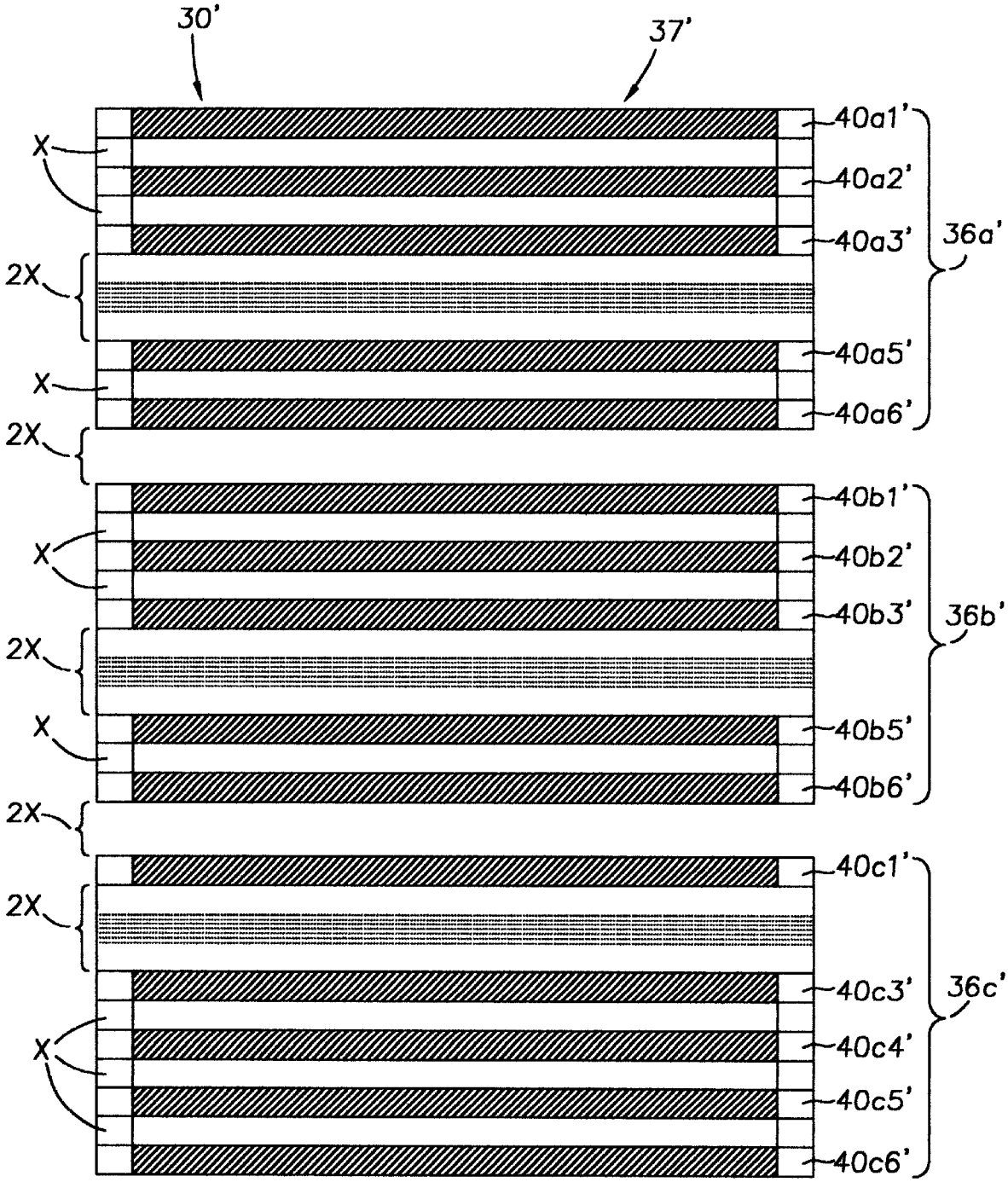
FIG. 4 is a schematic top plan view of the variable frequency foil box assembly of FIG. 3, showing foils having been removed from two foil sets.

In addition, one or more of the foil support beams 40' within a foil set can be removed to effect desirable changes to the rate at which water is drained from the stock. For example, as depicted in FIG. 4, the fourth foil beam 40*a*4' has been removed from the first foil set 36*a*', and foil beams 40*b*4' and 40*c*2' have been removed from the second and third foil sets 36*b*', 36*c*', respectively. Removal of foil beams preferably does not alter the Fourdrinier frequency once established. Removal of every other foil beam in a foil set results in a 2X spacing between foil beams and a frequency that is one-half of that achievable with a foil set in which all six foil beams 40' are provided at a spacing of "X".

The table frequency or Fourdrinier frequency is altered as a function of wire speed and foil pitch distance according to the following formula:

$$\frac{\text{Velocity of the wire (inch/second)}}{\text{Pitch distance between foils (inches)}}$$

Table 1 shows the Fourdrinier frequencies over a range of wire speeds and foil pitch distances, which is preferably about 50 hertz to about 90 hertz.

TABLE 1

Fourdrinier Frequency as a Function of Wire Speed and Foil Pitch Distance

| | | Foil Pitch | | | | | | | | | | |
|---|---|---|---|---|---|---|---|---|---|---|---|---|
| ft/min | in/sec | 1.00 | 1.25 | 1.50 | 1.75 | 2.00 | 2.25 | 2.50 | 2.75 | 3.00 | 3.25 | 3.50 |
| 500.00 | 100.00 | 100.00 | 80.00 | 66.67 | 57.14 | 50.00 | 44.44 | 40.00 | 36.36 | 33.33 | 30.77 | 28.57 |
| 600.00 | 120.00 | 120.00 | 96.00 | 80.00 | 68.57 | 60.00 | 53.33 | 48.00 | 43.64 | 40.00 | 36.92 | 34.29 |
| 700.00 | 140.00 | 140.00 | 112.00 | 93.33 | 80.00 | 70.00 | 62.22 | 56.00 | 50.91 | 46.67 | 43.08 | 40.00 |
| 800.00 | 160.00 | 160.00 | 128.00 | 106.67 | 91.43 | 80.00 | 71.11 | 64.00 | 58.18 | 53.33 | 49.23 | 45.71 |
| 900.00 | 180.00 | 180.00 | 144.00 | 120.00 | 102.86 | 90.00 | 80.00 | 72.00 | 65.45 | 60.00 | 55.38 | 51.43 |
| 1000.00 | 200.00 | 200.00 | 160.00 | 133.33 | 114.29 | 100.00 | 88.89 | 80.00 | 72.73 | 66.67 | 61.54 | 57.14 |
| 1100.00 | 220.00 | 220.00 | 176.00 | 146.67 | 125.71 | 110.00 | 97.78 | 88.00 | 80.00 | 73.33 | 67.69 | 62.86 |
| 1200.00 | 240.00 | 240.00 | 192.00 | 160.00 | 137.14 | 120.00 | 106.67 | 96.00 | 87.27 | 80.00 | 73.85 | 68.57 |
| 1300.00 | 260.00 | 260.00 | 208.00 | 173.33 | 148.57 | 130.00 | 115.56 | 104.00 | 94.55 | 86.67 | 80.00 | 74.29 |
| 1400.00 | 280.00 | 280.00 | 224.00 | 186.67 | 160.00 | 140.00 | 124.44 | 112.00 | 101.82 | 93.33 | 86.15 | 80.00 |
| 1500.00 | 300.00 | 300.00 | 240.00 | 200.00 | 171.43 | 150.00 | 133.33 | 120.00 | 109.09 | 100.00 | 92.31 | 85.71 |
| 1600.00 | 320.00 | 320.00 | 256.00 | 213.33 | 182.86 | 160.00 | 142.22 | 128.00 | 116.36 | 106.67 | 98.46 | 91.43 |
| 1700.00 | 340.00 | 340.00 | 272.00 | 226.67 | 194.29 | 170.00 | 151.11 | 136.00 | 123.64 | 113.33 | 104.62 | 97.14 |
| 1800.00 | 360.00 | 360.00 | 288.00 | 240.00 | 205.71 | 180.00 | 160.00 | 144.00 | 130.91 | 120.00 | 110.77 | 102.86 |
| 1900.00 | 380.00 | 380.00 | 304.00 | 253.33 | 217.14 | 190.00 | 168.89 | 152.00 | 138.18 | 126.67 | 116.92 | 108.57 |
| 2000.00 | 400.00 | 400.00 | 320.00 | 266.67 | 228.57 | 200.00 | 177.78 | 160.00 | 145.45 | 133.33 | 123.08 | 114.29 |
| 2100.00 | 420.00 | 420.00 | 336.00 | 280.00 | 240.00 | 210.00 | 186.67 | 168.00 | 152.73 | 140.00 | 129.23 | 120.00 |
| 2200.00 | 440.00 | 440.00 | 352.00 | 293.33 | 251.43 | 220.00 | 195.56 | 176.00 | 160.00 | 146.67 | 135.38 | 125.71 |
| 2300.00 | 460.00 | 460.00 | 368.00 | 306.67 | 262.86 | 230.00 | 204.44 | 184.00 | 167.27 | 153.33 | 141.54 | 131.43 |
| 2400.00 | 480.00 | 480.00 | 384.00 | 320.00 | 274.29 | 240.00 | 213.33 | 192.00 | 174.55 | 160.00 | 147.69 | 137.14 |
| 2500.00 | 500.00 | 500.00 | 400.00 | 333.33 | 285.71 | 250.00 | 222.22 | 200.00 | 181.82 | 166.67 | 153.85 | 142.86 |
| 2600.00 | 520.00 | 520.00 | 416.00 | 346.67 | 297.14 | 260.00 | 231.11 | 208.00 | 189.09 | 173.33 | 160.00 | 148.57 |
| 2700.00 | 540.00 | 540.00 | 432.00 | 360.00 | 308.57 | 270.00 | 240.00 | 216.00 | 196.36 | 180.00 | 166.15 | 154.29 |
| 2800.00 | 560.00 | 560.00 | 448.00 | 373.33 | 320.00 | 280.00 | 248.89 | 224.00 | 203.64 | 186.67 | 172.31 | 160.00 |
| 2900.00 | 580.00 | 580.00 | 464.00 | 386.67 | 331.43 | 290.00 | 257.78 | 232.00 | 210.91 | 193.33 | 178.46 | 165.71 |
| 3000.00 | 600.00 | 600.00 | 480.00 | 400.00 | 342.86 | 300.00 | 266.67 | 240.00 | 218.18 | 200.00 | 184.62 | 171.43 |
| 3100.00 | 620.00 | 620.00 | 496.00 | 413.33 | 354.29 | 310.00 | 275.56 | 248.00 | 225.45 | 206.67 | 190.77 | 177.14 |
| 3200.00 | 640.00 | 640.00 | 512.00 | 426.67 | 365.71 | 320.00 | 284.44 | 256.00 | 232.73 | 213.33 | 196.92 | 182.86 |
| 3300.00 | 660.00 | 660.00 | 528.00 | 440.00 | 377.14 | 330.00 | 293.33 | 264.00 | 240.00 | 220.00 | 203.08 | 188.57 |
| 3400.00 | 680.00 | 680.00 | 544.00 | 453.33 | 388.57 | 340.00 | 302.22 | 272.00 | 247.27 | 266.67 | 209.23 | 194.29 |
| 3500.00 | 700.00 | 700.00 | 560.00 | 466.67 | 400.00 | 350.00 | 311.11 | 280.00 | 254.55 | 233.33 | 215.38 | 200.00 |
| 3600.00 | 720.00 | 720.00 | 576.00 | 480.00 | 411.43 | 360.00 | 320.00 | 288.00 | 261.82 | 240.00 | 221.54 | 205.71 |
| 3700.00 | 740.00 | 740.00 | 592.00 | 493.33 | 422.86 | 370.00 | 328.89 | 296.00 | 269.09 | 246.67 | 227.69 | 211.43 |

TABLE 1-continued

Fourdrinier Frequency as a Function of Wire Speed and Foil Pitch Distance

| | | | | | | | | | | | | |
|---|---|---|---|---|---|---|---|---|---|---|---|---|
| 3800.00 | 760.00 | 760.00 | 608.00 | 506.67 | 434.29 | 380.00 | 337.78 | 304.00 | 276.36 | 253.33 | 233.85 | 217.14 |
| 3900.00 | 780.00 | 780.00 | 624.00 | 520.00 | 445.71 | 390.00 | 346.67 | 312.00 | 283.64 | 260.00 | 240.00 | 222.86 |
| 4000.00 | 800.00 | 800.00 | 640.00 | 533.33 | 457.14 | 400.00 | 355.56 | 320.00 | 290.91 | 266.67 | 246.15 | 228.57 |
| 4100.00 | 820.00 | 820.00 | 656.00 | 546.67 | 468.57 | 410.00 | 364.44 | 328.00 | 298.18 | 273.33 | 252.31 | 234.29 |
| 4200.00 | 840.00 | 840.00 | 672.00 | 560.00 | 480.00 | 420.00 | 373.33 | 336.00 | 305.45 | 280.00 | 258.46 | 240.00 |
| 4300.00 | 860.00 | 860.00 | 688.00 | 573.33 | 491.43 | 430.00 | 382.22 | 344.00 | 312.73 | 286.67 | 264.62 | 245.71 |
| 4400.00 | 880.00 | 880.00 | 704.00 | 586.67 | 502.86 | 440.00 | 391.11 | 352.00 | 320.00 | 293.33 | 270.77 | 251.43 |
| 4500.00 | 900.00 | 900.00 | 720.00 | 600.00 | 514.29 | 450.00 | 400.00 | 360.00 | 327.27 | 300.00 | 276.92 | 257.14 |

| | | Foil Pitch | | | | | | | | | |
|---|---|---|---|---|---|---|---|---|---|---|---|
| ft/min | in/sec | 3.75 | 4.00 | 4.25 | 4.50 | 4.75 | 5.00 | 5.25 | 5.50 | 5.75 | 6.00 |
| 500.00 | 100.00 | 26.67 | 25.00 | 23.53 | 22.22 | 21.05 | 20.00 | 19.05 | 18.18 | 17.39 | 16.67 |
| 600.00 | 120.00 | 32.00 | 30.00 | 28.24 | 26.67 | 25.26 | 24.00 | 22.86 | 21.82 | 20.87 | 20.00 |
| 700.00 | 140.00 | 37.33 | 35.00 | 32.94 | 31.11 | 29.47 | 28.00 | 26.67 | 25.45 | 24.35 | 23.33 |
| 800.00 | 160.00 | 42.67 | 40.00 | 37.65 | 35.56 | 33.68 | 32.00 | 30.48 | 29.09 | 27.83 | 26.67 |
| 900.00 | 180.00 | 48.00 | 45.00 | 42.35 | 40.00 | 37.89 | 36.00 | 34.29 | 32.73 | 31.30 | 30.00 |
| 1000.00 | 200.00 | 53.33 | 50.00 | 47.06 | 44.44 | 42.11 | 40.00 | 38.10 | 36.36 | 34.78 | 33.33 |
| 1100.00 | 220.00 | 58.67 | 55.00 | 51.76 | 48.89 | 46.32 | 44.00 | 41.90 | 40.00 | 38.26 | 36.67 |
| 1200.00 | 240.00 | 64.00 | 60.00 | 56.47 | 53.33 | 50.53 | 48.00 | 45.71 | 43.64 | 41.74 | 40.00 |
| 1300.00 | 260.00 | 69.33 | 65.00 | 61.18 | 57.78 | 54.74 | 52.00 | 49.52 | 47.27 | 45.22 | 43.33 |
| 1400.00 | 280.00 | 74.67 | 70.00 | 65.88 | 62.22 | 58.95 | 56.00 | 53.33 | 50.91 | 48.70 | 46.67 |
| 1500.00 | 300.00 | 80.00 | 75.00 | 70.59 | 66.67 | 63.16 | 60.00 | 57.14 | 54.65 | 52.17 | 50.00 |
| 1600.00 | 320.00 | 85.33 | 80.00 | 75.29 | 71.11 | 67.37 | 64.00 | 60.95 | 58.18 | 55.65 | 53.33 |
| 1700.00 | 340.00 | 90.67 | 85.00 | 80.00 | 75.58 | 71.58 | 68.00 | 64.76 | 61.82 | 59.13 | 56.67 |
| 1800.00 | 360.00 | 96.00 | 90.00 | 84.71 | 80.00 | 76.79 | 72.00 | 68.57 | 65.45 | 62.61 | 60.00 |
| 1900.00 | 380.00 | 101.33 | 95.00 | 89.41 | 84.44 | 80.00 | 76.00 | 72.38 | 69.09 | 66.09 | 63.33 |
| 2000.00 | 400.00 | 106.67 | 100.00 | 94.12 | 88.89 | 84.21 | 80.00 | 76.19 | 72.73 | 69.57 | 66.67 |
| 2100.00 | 420.00 | 112.00 | 105.00 | 98.82 | 93.33 | 88.42 | 84.00 | 80.00 | 76.36 | 73.04 | 70.00 |
| 2200.00 | 440.00 | 117.33 | 110.00 | 105.53 | 97.78 | 92.63 | 88.00 | 83.81 | 80.00 | 76.62 | 73.33 |
| 2300.00 | 460.00 | 122.67 | 115.00 | 108.24 | 102.22 | 96.84 | 92.00 | 87.62 | 83.64 | 80.00 | 76.67 |
| 2400.00 | 480.00 | 128.00 | 120.00 | 112.94 | 106.67 | 101.05 | 96.00 | 91.43 | 87.27 | 83.48 | 80.00 |
| 2500.00 | 500.00 | 133.33 | 125.00 | 117.65 | 111.11 | 105.26 | 100.00 | 95.24 | 90.91 | 86.98 | 83.33 |
| 2600.00 | 520.00 | 138.67 | 130.00 | 122.35 | 115.56 | 109.47 | 104.00 | 99.05 | 94.55 | 90.43 | 86.67 |
| 2700.00 | 540.00 | 144.00 | 135.00 | 127.06 | 120.00 | 113.68 | 108.00 | 102.86 | 98.18 | 93.91 | 90.00 |
| 2800.00 | 560.00 | 149.33 | 140.00 | 131.76 | 124.44 | 117.89 | 112.00 | 106.67 | 101.82 | 97.39 | 93.33 |
| 2900.00 | 580.00 | 154.67 | 145.00 | 136.47 | 128.89 | 122.11 | 116.00 | 110.48 | 105.45 | 100.87 | 96.67 |
| 3000.00 | 600.00 | 160.00 | 150.00 | 141.18 | 133.33 | 126.32 | 120.00 | 114.29 | 109.09 | 104.35 | 100.00 |
| 3100.00 | 620.00 | 165.33 | 155.00 | 145.88 | 137.78 | 130.53 | 124.00 | 118.10 | 112.73 | 107.83 | 103.33 |
| 3200.00 | 640.00 | 170.67 | 160.00 | 150.69 | 142.22 | 134.74 | 128.00 | 121.90 | 116.36 | 111.30 | 106.67 |
| 3300.00 | 660.00 | 176.00 | 165.00 | 155.29 | 146.67 | 138.95 | 132.00 | 125.71 | 120.00 | 114.78 | 110.00 |
| 3400.00 | 680.00 | 181.33 | 170.00 | 160.00 | 151.11 | 143.16 | 136.00 | 129.52 | 123.64 | 118.26 | 113.33 |
| 3500.00 | 700.00 | 186.67 | 175.00 | 164.71 | 155.56 | 147.37 | 140.00 | 133.33 | 127.27 | 121.74 | 116.67 |
| 3600.00 | 720.00 | 192.00 | 180.00 | 169.41 | 160.00 | 151.58 | 144.00 | 137.14 | 130.91 | 125.22 | 120.00 |
| 3700.00 | 740.00 | 197.33 | 185.00 | 174.12 | 164.44 | 155.79 | 148.00 | 140.95 | 134.55 | 128.70 | 123.33 |
| 3800.00 | 760.00 | 202.67 | 190.00 | 178.82 | 168.89 | 160.00 | 152.00 | 144.76 | 138.18 | 132.17 | 126.67 |
| 3900.00 | 780.00 | 208.00 | 195.00 | 185.53 | 173.33 | 164.21 | 156.00 | 148.57 | 141.82 | 135.65 | 130.00 |
| 4000.00 | 800.00 | 213.33 | 200.00 | 188.24 | 177.78 | 168.42 | 160.00 | 152.38 | 145.45 | 139.13 | 133.33 |
| 4100.00 | 820.00 | 218.67 | 205.00 | 192.94 | 182.22 | 172.63 | 164.00 | 156.19 | 149.09 | 142.61 | 136.67 |
| 4200.00 | 840.00 | 224.00 | 210.00 | 197.65 | 186.67 | 176.84 | 168.00 | 160.00 | 152.73 | 146.09 | 140.00 |
| 4300.00 | 860.00 | 229.33 | 215.00 | 202.35 | 191.11 | 181.05 | 172.00 | 163.81 | 156.36 | 149.57 | 143.33 |
| 4400.00 | 880.00 | 234.67 | 220.00 | 207.06 | 195.56 | 185.26 | 176.00 | 167.62 | 160.00 | 153.04 | 146.67 |
| 4500.00 | 900.00 | 240.00 | 225.00 | 211.76 | 200.00 | 189.47 | 180.00 | 171.43 | 163.64 | 156.52 | 150.00 |

| | | Foil Pitch | | | | | | | | | | | |
|---|---|---|---|---|---|---|---|---|---|---|---|---|---|
| ft/min | in/sec | | 6.25 | 6.50 | 6.75 | 7.00 | 7.25 | 7.50 | 7.75 | 8.00 | 8.25 | 8.50 | 8.75 |
| 500.00 | 100.00 | 100.00 | 16.00 | 15.38 | 14.81 | 14.29 | 13.79 | 13.33 | 12.90 | 12.50 | 12.12 | 11.76 | 11.43 |
| 600.00 | 120.00 | 120.00 | 19.20 | 18.45 | 17.78 | 17.14 | 16.55 | 16.00 | 15.48 | 15.00 | 14.55 | 14.12 | 13.71 |
| 700.00 | 140.00 | 140.00 | 22.40 | 21.54 | 20.74 | 20.00 | 19.31 | 18.67 | 18.06 | 17.50 | 16.97 | 16.47 | 16.00 |
| 800.00 | 160.00 | 160.00 | 25.60 | 24.52 | 23.70 | 22.86 | 22.07 | 21.33 | 20.55 | 20.00 | 19.39 | 18.82 | 18.29 |
| 900.00 | 180.00 | 180.00 | 28.80 | 27.69 | 26.67 | 25.71 | 24.83 | 24.00 | 23.23 | 22.50 | 21.82 | 21.18 | 20.57 |
| 1000.0 | 200.00 | 200.00 | 32.00 | 30.77 | 29.63 | 28.57 | 27.59 | 26.67 | 25.81 | 25.00 | 24.24 | 23.53 | 22.86 |
| 1100.0 | 220.00 | 220.00 | 35.20 | 33.85 | 32.59 | 31.43 | 30.34 | 29.33 | 28.39 | 27.50 | 26.67 | 25.88 | 25.14 |
| 1200.0 | 240.00 | 240.00 | 38.40 | 36.92 | 35.56 | 34.29 | 33.10 | 32.00 | 30.97 | 30.00 | 29.09 | 28.24 | 27.43 |
| 1300.0 | 260.00 | 260.00 | 41.60 | 40.00 | 38.52 | 37.14 | 35.86 | 34.67 | 33.55 | 32.50 | 31.52 | 30.59 | 29.71 |
| 1400.0 | 280.00 | 280.00 | 44.80 | 43.08 | 41.48 | 40.00 | 38.62 | 37.33 | 36.13 | 35.00 | 33.94 | 32.94 | 32.00 |
| 1500.0 | 300.00 | 300.00 | 48.00 | 46.15 | 44.44 | 42.86 | 41.38 | 40.00 | 38.71 | 37.50 | 36.36 | 35.29 | 34.29 |
| 1600.0 | 320.00 | 320.00 | 51.20 | 49.23 | 47.41 | 45.71 | 44.14 | 42.67 | 41.29 | 40.00 | 38.79 | 37.65 | 36.57 |
| 1700.0 | 340.00 | 340.00 | 54.40 | 52.31 | 50.37 | 48.57 | 46.90 | 45.33 | 43.87 | 42.50 | 41.21 | 40.00 | 38.86 |
| 1800.0 | 360.00 | 360.00 | 57.60 | 55.38 | 53.33 | 51.43 | 49.66 | 48.00 | 46.45 | 45.00 | 43.64 | 42.35 | 41.14 |
| 1900.0 | 380.00 | 380.00 | 60.80 | 58.48 | 56.30 | 54.29 | 52.41 | 50.67 | 49.03 | 47.50 | 46.06 | 44.71 | 43.43 |
| 2000.0 | 400.00 | 400.00 | 64.00 | 61.54 | 59.26 | 57.14 | 55.17 | 53.33 | 51.61 | 50.00 | 48.48 | 47.06 | 45.71 |
| 2100.0 | 420.00 | 420.00 | 67.20 | 64.52 | 62.22 | 60.00 | 57.93 | 56.00 | 54.19 | 52.50 | 50.91 | 49.41 | 48.00 |
| 2200.0 | 440.00 | 440.00 | 70.40 | 67.69 | 65.19 | 62.80 | 60.00 | 58.67 | 56.77 | 55.00 | 53.33 | 51.76 | 50.29 |

TABLE 1-continued

Fourdrinier Frequency as a Function of Wire Speed and Foil Pitch Distance

| | | | | | | | | | | | | | |
|---|---|---|---|---|---|---|---|---|---|---|---|---|---|
| 2300.0 | 460.00 | 460.00 | 73.60 | 70.77 | 68.16 | 65.71 | 63.45 | 61.33 | 59.35 | 57.50 | 55.76 | 54.12 | 52.57 |
| 2400.0 | 480.00 | 480.00 | 76.80 | 73.85 | 71.11 | 68.57 | 66.21 | 64.00 | 61.94 | 60.00 | 58.18 | 56.47 | 54.86 |
| 2500.0 | 500.00 | 500.00 | 80.00 | 76.92 | 74.07 | 71.43 | 68.97 | 66.67 | 64.52 | 62.50 | 60.61 | 58.82 | 57.14 |
| 2600.0 | 520.00 | 520.00 | 83.20 | 80.00 | 77.04 | 74.29 | 71.72 | 69.33 | 67.10 | 65.00 | 63.03 | 61.18 | 59.43 |
| 2700.0 | 540.00 | 540.00 | 86.40 | 83.08 | 80.00 | 77.14 | 74.48 | 72.00 | 69.68 | 67.50 | 65.45 | 63.63 | 61.71 |
| 2800.0 | 560.00 | 560.00 | 89.60 | 86.15 | 82.96 | 80.00 | 77.24 | 74.67 | 72.26 | 70.00 | 67.88 | 65.88 | 64.00 |
| 2900.0 | 580.00 | 580.00 | 92.80 | 89.23 | 85.93 | 82.86 | 80.00 | 77.33 | 74.84 | 72.50 | 70.30 | 68.24 | 66.29 |
| 3000.0 | 600.00 | 600.00 | 96.00 | 92.31 | 88.89 | 85.71 | 82.76 | 80.00 | 77.42 | 76.00 | 72.73 | 70.59 | 68.57 |
| 3100.0 | 620.00 | 620.00 | 99.20 | 96.38 | 91.85 | 88.67 | 85.62 | 82.67 | 80.00 | 77.50 | 75.15 | 72.94 | 70.86 |
| 3200.0 | 640.00 | 640.00 | 102.40 | 98.46 | 94.81 | 91.43 | 88.28 | 85.33 | 82.58 | 80.00 | 77.58 | 75.29 | 73.14 |
| 3300.0 | 660.00 | 660.00 | 105.60 | 101.54 | 97.87 | 94.29 | 91.03 | 88.00 | 86.16 | 82.50 | 80.00 | 77.65 | 75.43 |
| 3400.0 | 680.00 | 680.00 | 108.80 | 104.62 | 100.74 | 97.14 | 93.79 | 90.67 | 87.74 | 85.00 | 82.42 | 80.00 | 77.71 |
| 3500.0 | 700.00 | 700.00 | 112.00 | 107.69 | 103.70 | 100.00 | 96.55 | 93.33 | 90.32 | 87.50 | 84.85 | 82.35 | 80.00 |
| 3600.0 | 720.00 | 720.00 | 115.20 | 110.77 | 106.67 | 102.86 | 99.31 | 96.00 | 92.90 | 90.00 | 87.27 | 84.71 | 82.29 |
| 3700.0 | 740.00 | 740.00 | 118.40 | 113.85 | 109.63 | 105.71 | 102.07 | 98.67 | 95.48 | 92.50 | 89.70 | 87.06 | 84.67 |
| 3800.0 | 760.00 | 760.00 | 121.60 | 116.92 | 112.59 | 108.57 | 104.83 | 101.33 | 98.06 | 95.00 | 92.12 | 89.41 | 86.86 |
| 3900.0 | 780.00 | 780.00 | 124.80 | 120.00 | 115.56 | 111.43 | 107.59 | 104.00 | 100.65 | 97.50 | 94.55 | 91.76 | 89.14 |
| 4000.0 | 800.00 | 800.00 | 128.00 | 123.08 | 118.52 | 114.29 | 110.34 | 106.67 | 103.23 | 100.00 | 96.97 | 94.12 | 91.43 |
| 4100.0 | 820.00 | 820.00 | 131.20 | 126.15 | 121.48 | 117.14 | 113.10 | 109.33 | 105.81 | 102.50 | 99.39 | 96.47 | 93.71 |
| 4200.0 | 840.00 | 840.00 | 134.40 | 129.23 | 124.44 | 120.00 | 115.86 | 112.00 | 108.39 | 105.00 | 101.82 | 98.82 | 96.00 |
| 4300.0 | 860.00 | 860.00 | 137.60 | 132.31 | 127.41 | 122.86 | 118.62 | 114.67 | 110.97 | 107.50 | 104.24 | 101.18 | 98.29 |
| 4400.0 | 880.00 | 880.00 | 140.80 | 135.38 | 130.37 | 125.71 | 121.38 | 117.33 | 113.55 | 110.00 | 106.67 | 103.53 | 100.57 |
| 4500.0 | 900.00 | 900.00 | 144.00 | 138.46 | 133.33 | 128.57 | 124.14 | 120.00 | 116.13 | 112.50 | 109.09 | 105.88 | 102.86 |

| | | Foil pitch | | | | | | | | | | | | |
|---|---|---|---|---|---|---|---|---|---|---|---|---|---|---|
| ft/min | in/sec | 9.00 | 9.25 | 9.50 | 9.75 | 10.00 | 10.25 | 10.50 | 10.75 | 11.00 | 11.25 | 11.50 | 11.75 | 12.00 |
| 500.00 | 100.00 | 11.11 | 10.81 | 10.53 | 10.26 | 10.00 | 9.76 | 9.52 | 9.30 | 9.09 | 8.89 | 8.70 | 8.51 | 8.33 |
| 600.00 | 120.00 | 13.33 | 12.97 | 12.63 | 12.31 | 12.00 | 11.71 | 11.43 | 11.16 | 10.91 | 10.67 | 10.43 | 10.21 | 10.00 |
| 700.00 | 140.00 | 15.56 | 15.14 | 14.74 | 14.36 | 14.00 | 13.66 | 13.33 | 13.02 | 12.73 | 12.44 | 12.17 | 11.91 | 11.67 |
| 800.00 | 160.00 | 17.78 | 17.30 | 16.84 | 16.41 | 16.00 | 15.61 | 15.24 | 14.88 | 14.55 | 14.22 | 13.91 | 13.62 | 13.33 |
| 900.00 | 180.00 | 20.00 | 19.46 | 18.95 | 18.46 | 18.00 | 17.56 | 17.14 | 16.74 | 16.36 | 16.00 | 15.65 | 15.32 | 15.00 |
| 1000.0 | 200.00 | 22.22 | 21.62 | 21.05 | 20.51 | 20.00 | 19.51 | 19.05 | 18.60 | 18.18 | 17.78 | 17.39 | 17.02 | 16.67 |
| 1100.0 | 220.00 | 24.44 | 23.76 | 23.16 | 22.56 | 22.00 | 21.46 | 20.95 | 20.47 | 20.00 | 19.56 | 19.13 | 18.72 | 18.33 |
| 1200.0 | 240.00 | 26.67 | 25.95 | 25.26 | 24.62 | 24.00 | 23.41 | 22.86 | 22.33 | 21.82 | 21.33 | 20.87 | 20.43 | 20.00 |
| 1300.0 | 260.00 | 28.89 | 28.11 | 27.37 | 26.67 | 26.00 | 25.37 | 24.76 | 24.19 | 23.64 | 23.11 | 22.61 | 22.13 | 21.67 |
| 1400.0 | 280.00 | 31.11 | 30.27 | 29.47 | 28.72 | 28.00 | 27.32 | 26.67 | 26.05 | 25.45 | 24.89 | 24.35 | 23.83 | 23.33 |
| 1500.0 | 300.00 | 33.33 | 32.43 | 31.58 | 30.77 | 30.00 | 29.27 | 28.57 | 27.91 | 27.27 | 26.67 | 25.09 | 25.53 | 25.00 |
| 1600.0 | 320.00 | 35.56 | 34.59 | 33.68 | 32.82 | 32.00 | 31.22 | 30.48 | 29.77 | 29.09 | 28.44 | 27.83 | 27.23 | 26.67 |
| 1700.0 | 340.00 | 37.78 | 36.76 | 35.79 | 34.87 | 34.00 | 33.17 | 32.38 | 31.63 | 30.91 | 30.22 | 29.57 | 28.94 | 28.33 |
| 1800.0 | 360.00 | 40.00 | 38.92 | 37.89 | 36.92 | 36.00 | 35.12 | 34.29 | 33.49 | 32.73 | 32.00 | 31.30 | 30.64 | 30.00 |
| 1900.0 | 380.00 | 42.22 | 41.08 | 40.00 | 38.97 | 38.00 | 37.07 | 36.19 | 35.35 | 34.55 | 33.78 | 33.04 | 32.34 | 31.67 |
| 2000.0 | 400.00 | 44.44 | 43.24 | 42.11 | 41.03 | 40.00 | 39.02 | 38.10 | 37.21 | 36.36 | 35.56 | 34.78 | 34.04 | 33.33 |
| 2100.0 | 420.00 | 46.67 | 45.41 | 44.21 | 43.08 | 42.00 | 40.98 | 40.00 | 39.07 | 38.18 | 37.33 | 36.52 | 35.74 | 35.00 |
| 2200.0 | 440.00 | 48.89 | 47.57 | 46.32 | 45.13 | 44.00 | 42.93 | 41.90 | 40.93 | 40.00 | 39.11 | 38.26 | 37.45 | 36.67 |
| 2300.0 | 460.00 | 51.11 | 49.73 | 48.42 | 47.18 | 46.00 | 44.88 | 43.81 | 42.79 | 41.82 | 40.89 | 40.00 | 39.15 | 38.33 |
| 2400.0 | 480.00 | 53.33 | 51.89 | 50.53 | 49.23 | 48.00 | 46.83 | 45.71 | 44.65 | 43.64 | 42.67 | 41.74 | 40.85 | 40.00 |
| 2500.0 | 500.00 | 55.66 | 54.05 | 52.63 | 51.28 | 50.00 | 48.78 | 47.62 | 46.51 | 45.45 | 44.44 | 43.48 | 42.55 | 41.67 |
| 2600.0 | 520.00 | 57.78 | 56.22 | 54.74 | 53.33 | 52.00 | 50.73 | 49.52 | 48.37 | 47.27 | 46.22 | 45.22 | 44.26 | 43.33 |
| 2700.0 | 540.00 | 60.00 | 58.38 | 56.84 | 55.38 | 54.00 | 52.68 | 51.43 | 50.23 | 49.09 | 48.00 | 46.96 | 45.96 | 45.00 |
| 2800.0 | 560.00 | 62.22 | 60.54 | 58.95 | 57.44 | 56.00 | 54.63 | 53.33 | 52.09 | 50.91 | 49.78 | 48.70 | 47.66 | 46.67 |
| 2900.0 | 580.00 | 64.44 | 62.70 | 61.06 | 59.49 | 58.00 | 56.59 | 55.24 | 53.95 | 52.73 | 51.56 | 50.43 | 49.36 | 48.33 |
| 3000.0 | 600.00 | 66.67 | 64.86 | 63.16 | 61.54 | 60.00 | 58.54 | 57.14 | 55.81 | 54.55 | 53.33 | 52.17 | 51.06 | 50.00 |
| 3100.0 | 620.00 | 68.89 | 67.03 | 65.26 | 63.59 | 62.00 | 60.49 | 59.06 | 57.67 | 56.36 | 55.11 | 53.91 | 52.77 | 51.67 |
| 3200.0 | 640.00 | 71.11 | 69.19 | 67.37 | 65.64 | 64.00 | 62.44 | 60.95 | 59.53 | 58.18 | 56.89 | 55.65 | 54.47 | 53.33 |
| 3300.0 | 660.00 | 73.33 | 71.35 | 69.47 | 67.69 | 66.00 | 64.38 | 62.86 | 61.40 | 60.00 | 58.67 | 57.39 | 55.17 | 55.00 |
| 3400.0 | 680.00 | 75.56 | 73.51 | 71.58 | 69.74 | 68.00 | 66.34 | 64.76 | 63.26 | 61.82 | 60.44 | 59.13 | 57.87 | 56.67 |
| 3500.0 | 700.00 | 77.78 | 75.68 | 73.68 | 71.79 | 70.00 | 68.29 | 66.67 | 65.12 | 63.64 | 62.22 | 60.87 | 59.67 | 58.33 |
| 3600.0 | 720.00 | 80.00 | 77.84 | 75.79 | 73.85 | 72.00 | 70.24 | 68.57 | 66.98 | 65.45 | 64.00 | 62.61 | 61.28 | 60.00 |
| 3700.0 | 740.00 | 82.22 | 80.00 | 77.89 | 75.90 | 74.00 | 72.20 | 70.48 | 68.84 | 67.27 | 65.76 | 64.35 | 62.98 | 61.67 |
| 3800.0 | 760.00 | 84.44 | 82.16 | 80.00 | 77.95 | 76.00 | 74.15 | 72.38 | 70.70 | 69.09 | 67.56 | 66.09 | 64.68 | 63.33 |
| 3900.0 | 780.00 | 86.67 | 84.32 | 82.11 | 80.00 | 78.00 | 76.10 | 74.29 | 72.56 | 70.91 | 69.33 | 67.83 | 66.38 | 65.00 |
| 4000.0 | 800.00 | 88.89 | 86.49 | 84.21 | 82.05 | 80.00 | 78.05 | 76.19 | 74.42 | 72.73 | 71.11 | 69.57 | 68.09 | 66.67 |
| 4100.0 | 820.00 | 91.11 | 88.65 | 86.32 | 84.10 | 82.00 | 80.00 | 78.10 | 76.28 | 74.56 | 72.89 | 71.30 | 69.79 | 68.33 |
| 4200.0 | 840.00 | 93.33 | 90.81 | 88.42 | 86.15 | 84.00 | 81.95 | 80.00 | 78.14 | 76.36 | 74.67 | 73.04 | 71.49 | 70.00 |
| 4300.0 | 860.00 | 95.56 | 92.97 | 90.53 | 88.21 | 86.00 | 83.90 | 81.90 | 80.00 | 78.18 | 76.44 | 74.78 | 73.19 | 71.67 |
| 4400.0 | 880.00 | 97.78 | 95.14 | 92.63 | 90.26 | 88.00 | 85.85 | 83.81 | 81.86 | 80.00 | 78.22 | 76.52 | 74.89 | 73.33 |
| 4500.0 | 900.00 | 100.00 | 97.30 | 94.74 | 92.31 | 90.00 | 87.80 | 85.71 | 83.72 | 81.82 | 80.00 | 78.26 | 76.60 | 75.00 |

Figure 5:
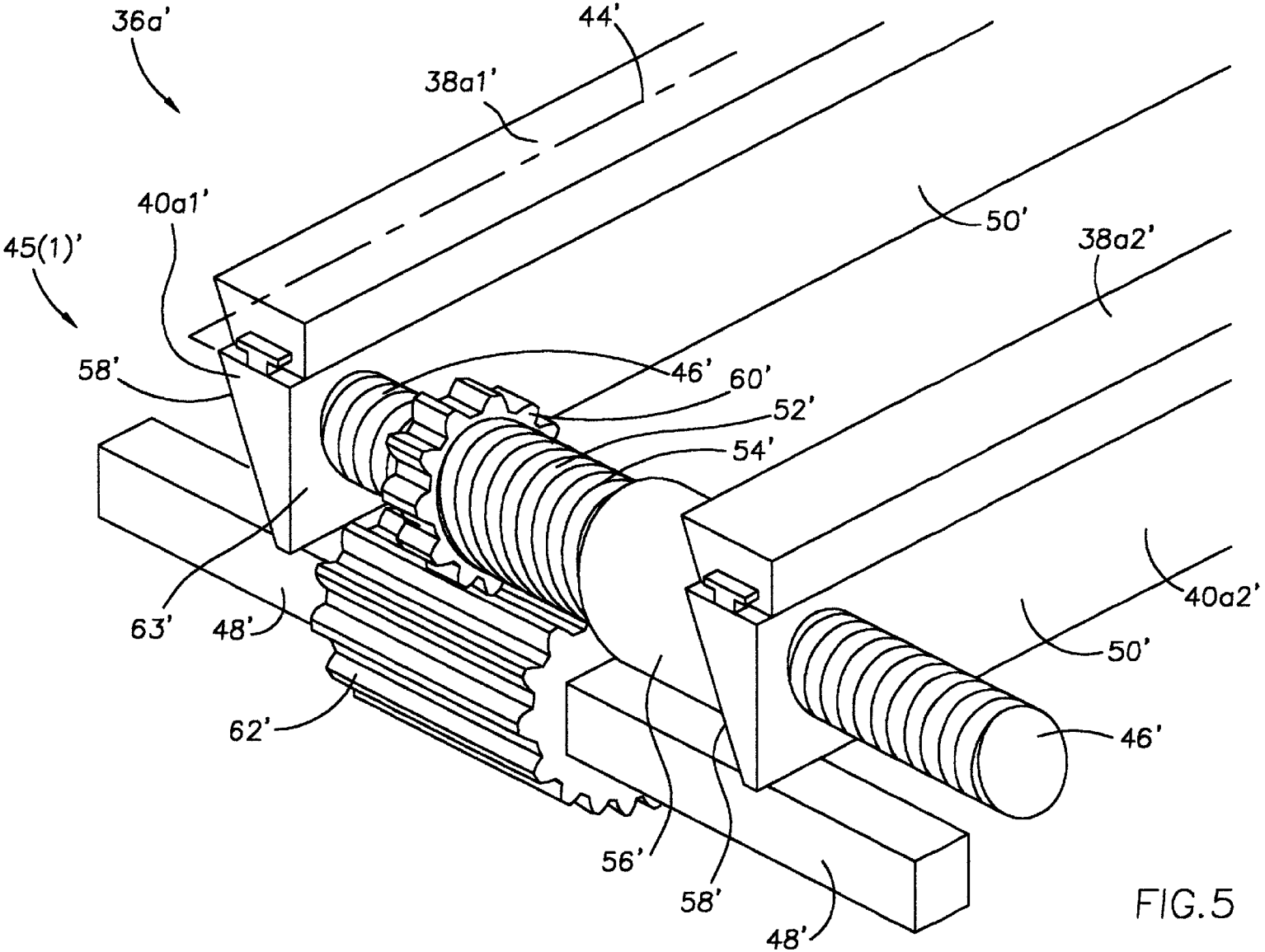
FIG. 5 is a perspective, partial view of embodiment of a variable frequency foil box according to the invention utilizing a double acting screw mechanism to move the foil support beams.

One embodiment of an actuating mechanism 45(1)' utilized in a variable frequency foil box (set) according to the invention to alter the frequency of a Fourdrinier table is depicted in FIG. 5, illustrated as VFF box (set) 36*a*' for explanation purposes. The actuating mechanism 45(1)' of the VFF set 36*a*' comprises a series combination of double-lead acme type screws 46' engaged with a single rotatable carrier or device shaft 48' via spur gears 60', 62', which utilizes a common actuating means (not shown), such as an electric motor, an air motor and valving system, or other mechanism known and used in the art. The actuating mechanism 45(1)' is operable to provide equidistant spacing of the foil support beams 40', and adjacent foil sets (36') (not shown) on the Fourdrinier table. The shaft 48' is oriented perpendicular to the foil support beams. A male threaded lead screw 46' is affixed to the trailing side 50' of each foil support beam 40*a*1', 40*a*2'. A "double threaded" rotating nut 52' with a mating female thread on the inner surface (not shown) is engaged onto the male threaded lead screw 46'. The outside diameter of the nut 52' is machined with an opposite hand thread (outer thread) 54' of identical pitch as the male threaded lead screw 46'. The outer thread 54' of the rotatable nut 52' is engaged with the inner threads (not shown) of a mating (fixed) nut 56' affixed to the leading side 58' of the following (trailing) foil support beam 40*a*2'. A gear 60' affixed to the face of the rotatable nut 52' meshes with a second gear 62' affixed to a rotatable carrier shaft 48'.

Rotating the carrier shaft 48' turns the double threaded rotatable nut 52'. As the double threaded nut 52' turns in one direction, it further engages the lead screw 46' on the leading foil support beam 40*a*1' while being further engaged into the mating (fixed) nut 56' mounted on the trailing foil support beam 40*a*2'. As the carrier shaft 48' rotates in the opposite direction, the process reverses. The carrier shaft 48' has additional gears affixed to it (not shown) that simultaneously actuate an identical mechanism for the subsequent foil support beams 40*a*3', 40*a*4', 40*a*5' (not shown). With the first (leading) foil beam 40*a*1', 40*b*1', 40*c*1' of each foil set 41*a*'–41*c*' affixed to the box, and each subsequent foil beam connected to the preceding foil beam via the aforementioned mechanism, equidistant spacing of the intermediate and trailing foil beams is maintained throughout the range of adjustment. The actuating mechanism 45(1)' is preferably located at or near the ends 63' of the foil support beams 40'. Additional mechanisms 45(1) can be equally spaced between the ends on boxes of greater width.

Figure 6:
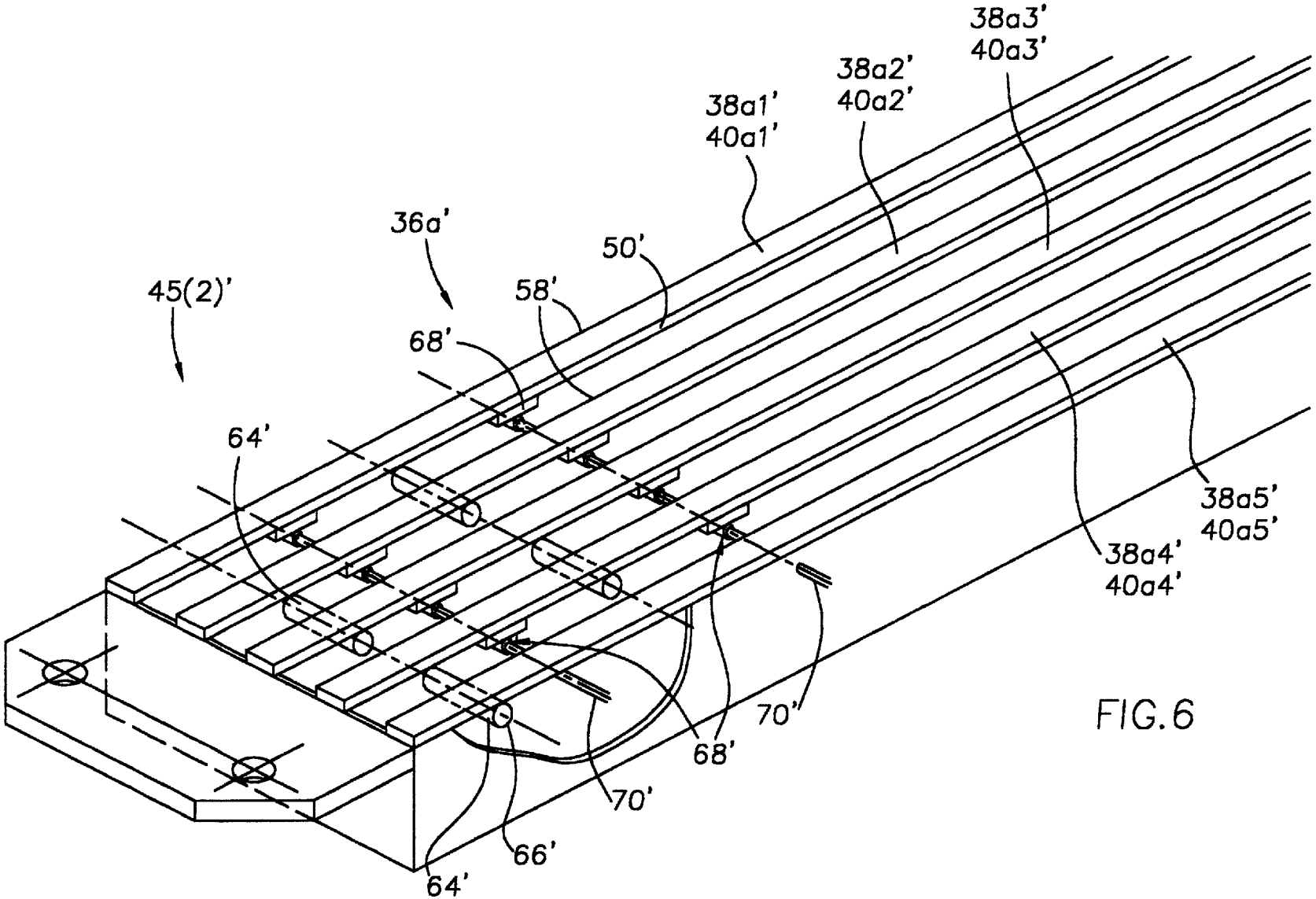
FIG. 6 is a perspective view of another embodiment of a variable frequency foil box according to the invention utilizing a foil box arrangement using a hydraulic/pneumatic cylinder mechanism to move the foil support beams.

Another embodiment of a variable frequency foil (VFF) box of the invention is depicted in FIG. 6, illustrated as VFF box 36*a*'. As shown, VFF box 36*a*' comprises five foils 38*a*1'–38*a*5', each mounted on a foil support beam 40*a*1'–40*a*5'. As further depicted, the variable frequency foil box 36*a*' utilizes an actuating mechanism 45(2)' comprising a series combination of hydraulic or pneumatic cylinders 64' with integral position feedback transducers 66', utilizing an electronically-controlled system of actuating valves (not shown). The actuating mechanism 45(2)' is utilized to accomplish the equidistant spacing of foils 38*a*1'–38*a*5' and adjacent foil sets (not shown) by lateral movement. In the illustrated embodiment, at least two hydraulic or pneumatic cylinders 64' are attached to each foil support beam 40*a*1'–40*a*5' with the ends of the cylinders (rod-ends), affixed to the upstream (leading) side 58' of the foil beam or the downstream (trailing) side 50' of the foil beam (as shown). The individual foil beams 40*a*1'–40*a*5' are preferably supported by at least two linear bearings 68' (i.e., linear pillow blocks) that are supported by shafts 70' oriented perpendicular to the foil support beams 40*a*1'–0*a*5' to insure the lateral alignment of the beams in the machine such that the support beams are held down and do not move in either lateral or vertical directions.

An electronic control system utilizing a programmable logic controller (PLC) (not shown) can be used to actuate the cylinder valves 64' to effect changes in the relative position of adjacent foil support beams 40*a*1–40*a*5'. The cylinders 64' preferably comprise position transducers 66' that provide a feedback signal to the PLC to indicate position changes. Further "tuning" of the foil positions can be effected by the PLC to position the foil beams 40*a*1'–40*a*5' and foils 38*a*1'–38*a*5' in the precise location(s) required to achieve the desired box frequency.

Figure 7:
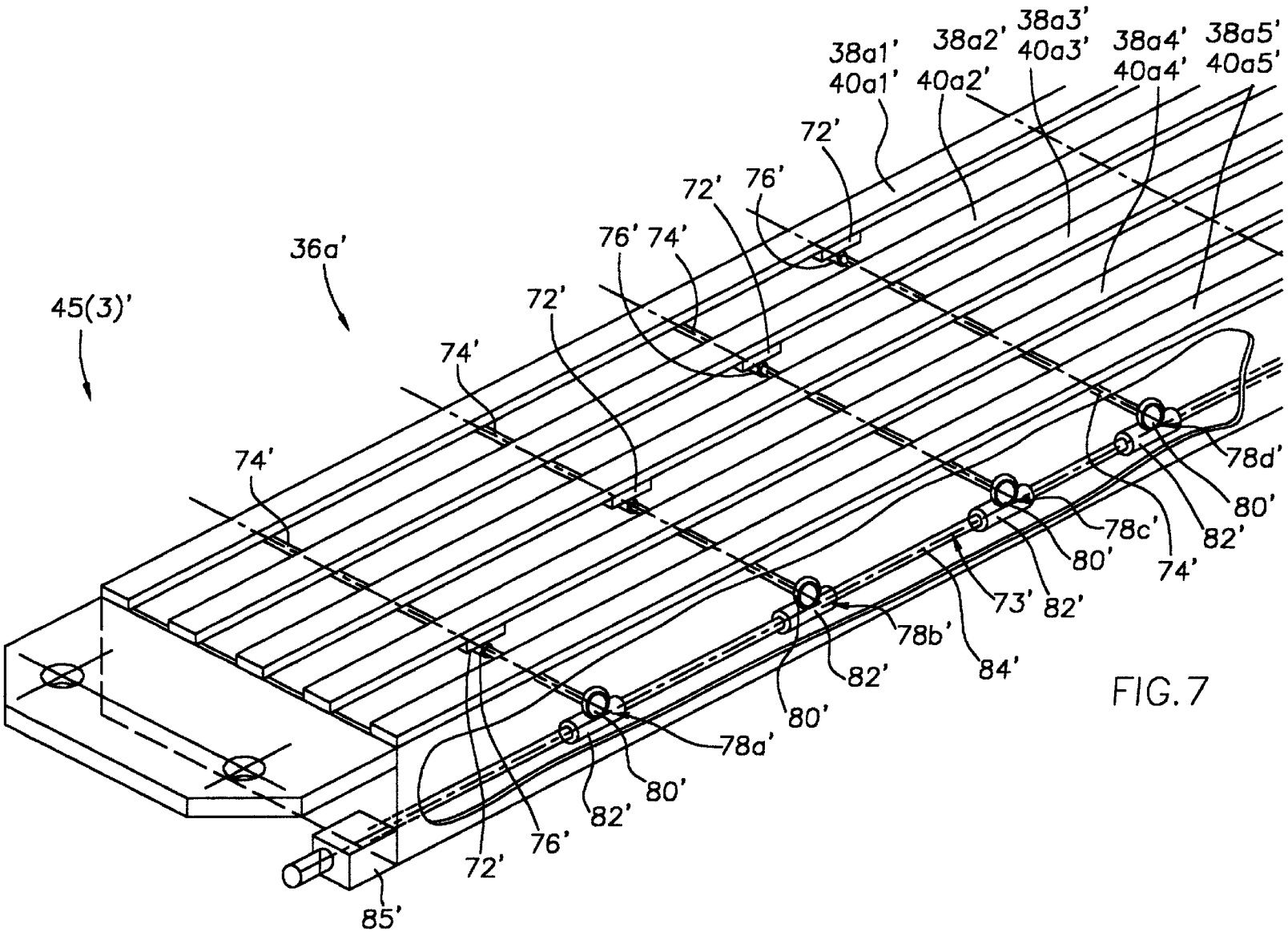
FIG. 7 is a perspective view of another embodiment of a variable frequency foil box according to the invention utilizing a multiple lead screw mechanism to move the foil support beams.

Another embodiment of a variable frequency foil box according to the invention is depicted in FIG. 7, illustrated as VFF box 36*a*' for discussion purposes. As shown, the variable frequency foil box 36*a*' utilizes an actuating mechanism 45(3)' comprising a series of actuating (lead) screw (ball screw) assemblies 72', along with a common actuator 73', which are utilized to accomplish the equidistant spacing of foils 38*a*1'–38*a*5' and adjacent foil sets (not shown). In this embodiment, each foil support beam 40*a*1'–40*a*5' incorporates a nut 76' into which an actuating (lead) screw 74' is engaged, the axis of the actuating screw being perpendicular to that of the foil support beams assemblies positioned along the length of the foil beam. The actuating screw 74' extends forward (or backward) to a point beyond the leading foil beam 40*a*1' (or trailing foil beam 40*a*2'–40*a*5'). The actuating means (actuator) 73' for each actuating screw assembly 72' comprises a worm gear assembly (or worm and pinion assembly) 78*a*'–78*d*' whereby the gear 80' is affixed to the actuating screw 74' and the engaging worms 82' are coupled in parallel by a common drive shaft 84' that is connected to an actuating device 85' such as a drive motor, a hydraulic or pneumatic pump, an air compressor and valve system, or other like mechanism known and used in the art for turning a drive shaft. The worm gear ratios increase incrementally from one actuating screw to the next actuating screw, for example, a ratio of about 10:1 for worm gear assembly 78*a*', an about 10:2 ratio for assembly 78*b*, an about 10:3 ratio for assembly 78*c*', an about 10:4 ratio for assembly 78*d*', and so forth, whereby ten (10) revolutions of the worm 82' yields one (1) (or 2, 3, 4, etc.) revolution of the gear 80' to insure the equidistant spacing of each foil beam 40*a*1'–40*a*5' throughout their respective ranges of motion. Referring to the embodiment shown in FIG. 6, the individual foil beams 40*a*1'–40*a*5' are preferably supported by at least two linear bearings (i.e., linear pillow blocks) 68' that are supported by shafts 70' oriented perpendicular to the foil beams 40*a*1'–40*a*5' to insure the lateral alignment of the beams in the machine such that the beams are held down and do not move in either lateral or vertical directions. The linear bearings (68') can be designed and sized such that the actuating lead screws 74' pass through the linear bearings (68') without engaging screw threads, in order to provide additional support to the actuating screws 74'. With this embodiment, the number of parts (i.e., part count) that comprise the assembly 45(3)' and subsequent alignment requirements are greatly simplified.

Figure 8A:
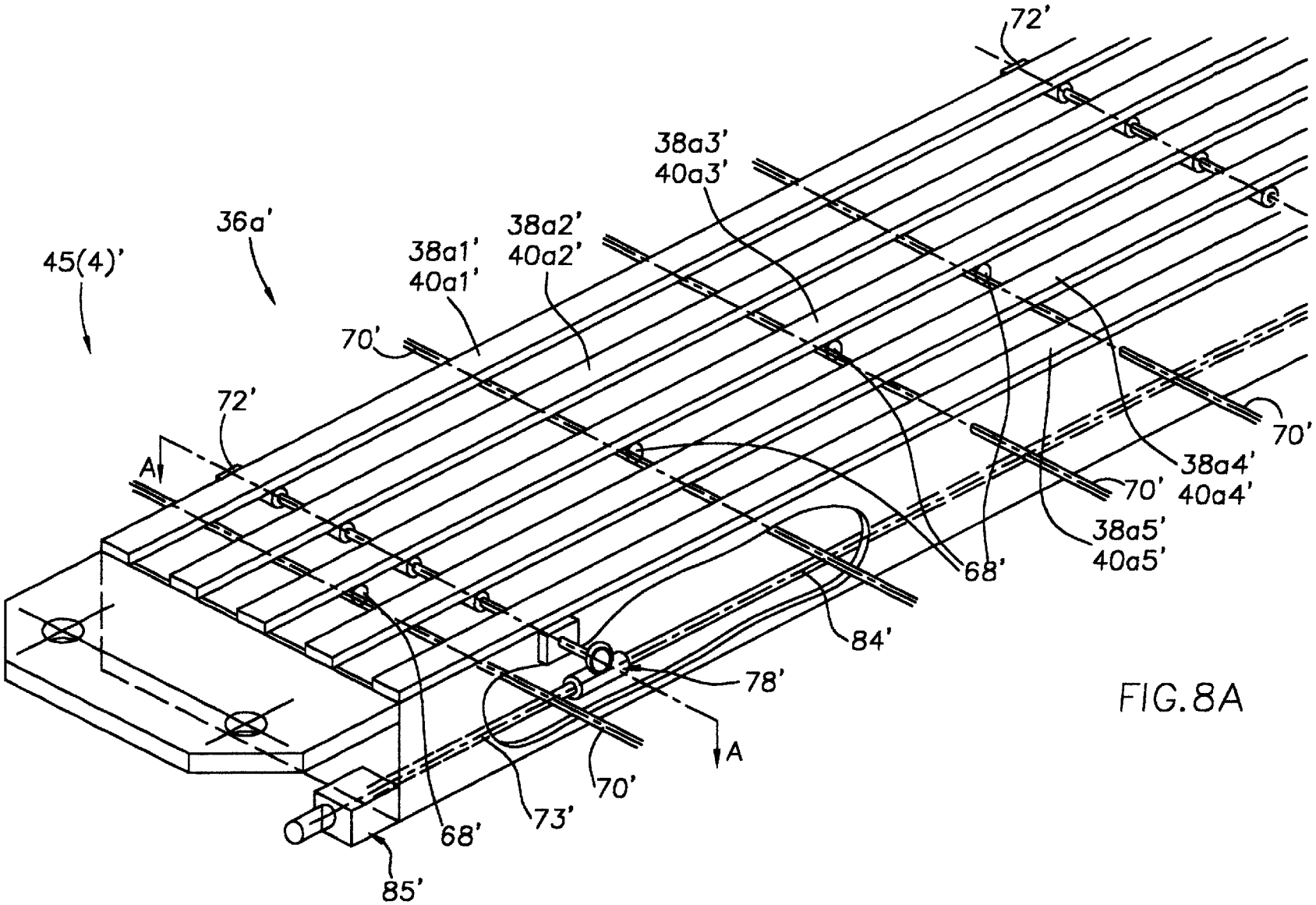
FIGS. 8A–8C are illustrations of another embodiment of a variable frequency foil box according to the invention utilizing pantograph assemblies to move the foil support beams.
Figure 8B:
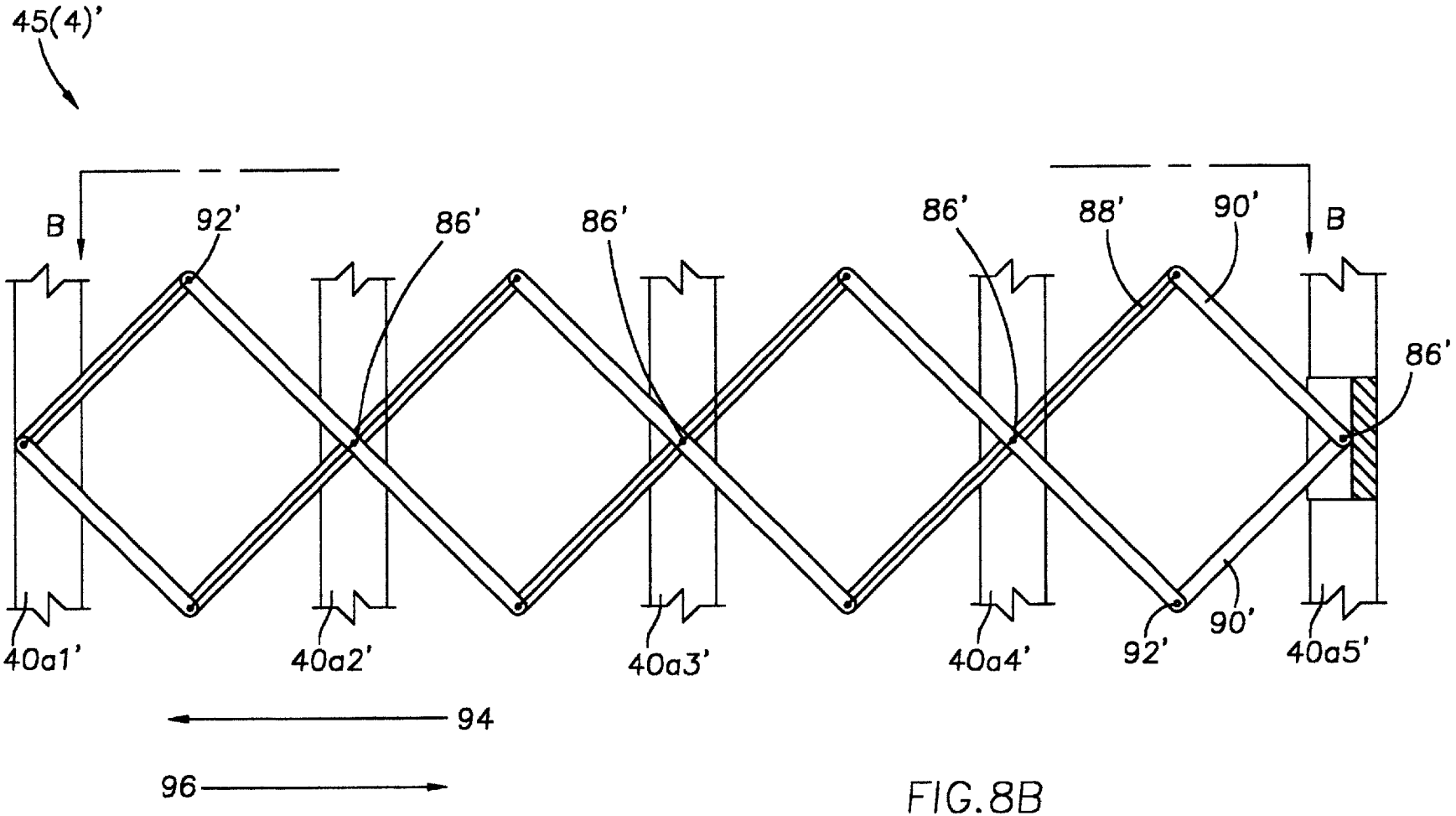
Figure 8C:
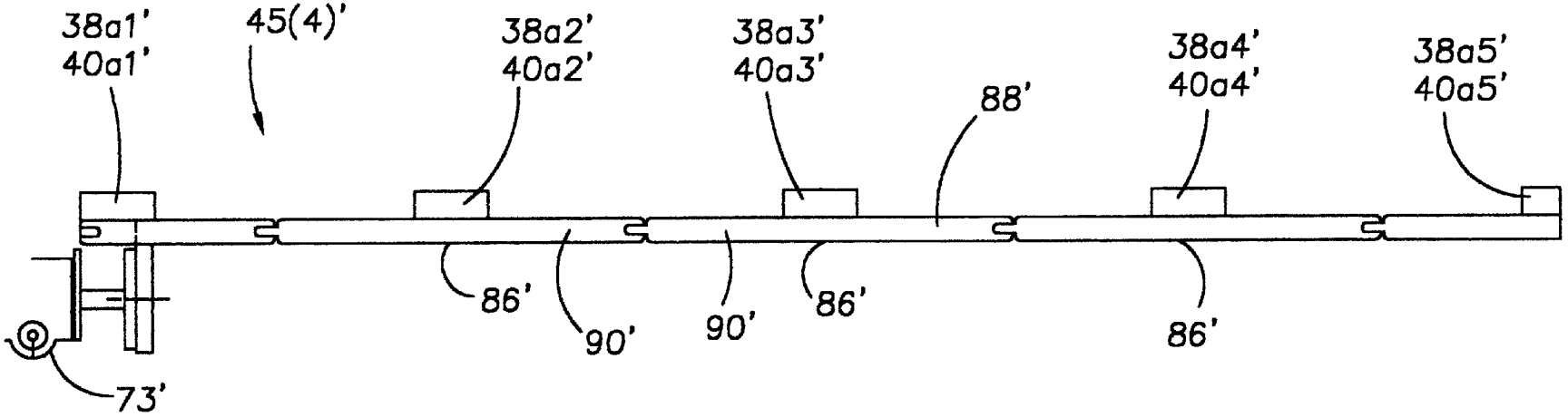

As shown in FIGS. 8A–8C, in another embodiment of a variable frequency foil box, illustrated as VFF set 36*a*', at least two pantograph assemblies 88' are utilized as a mechanism 45(4)' along with a common actuating means (actuator) (not shown) to accomplish the equidistant spacing of the foil beams 40*a*1'–40*a*5', and adjacent foil sets (not shown). Referring to FIG. 8B, each foil beam 40*a*1'–40*a*5' is attached to a center pivot 86' of the pantograph assembly 88' which, by design, insures that the spacing between the foil support beams 40*a*1'–40*a*5' remains substantially equidistant throughout the range of motion. The pantograph assembly 88' comprises links 90' that are secured with a fastener 92' at the pivot point of the links, including the center pivots 86' of the pantograph assembly. In operation, the pantograph assembly 88' accordions or extends (expands) outward (arrow 94') and retracts inward (arrow 96'), which draws at least the intermediate foil beams 40*a*2'–40*a*4' along and into position. The position of the trailing blade 38*a*5' can be adjusted by use of at least two linear actuating (lead) screw assemblies 72' connected in parallel by a common drive shaft 84', and attached to both the leading foil beam 40*a*1' and the trailing foil beam 40*a*5'. As the actuating screw assembly 72' moves the trailing foil beam 40*a*5', the pantograph assembly 88' draws the intermediate foil beams 40*a*2' '*a*4' , which are moved proportionally with the trailing foil beam 40*a*5'. The individual foil beams 40*a*1'–40*a*5' are preferably supported by at least two linear bearings 68' (i.e., linear pillow blocks) supported by shafts 70' oriented perpendicular to the foil support beams 40*a*1'–40*a*5' to insure the lateral alignment of the beams in the machine and to control lateral and vertical movement.

Figure 9A:
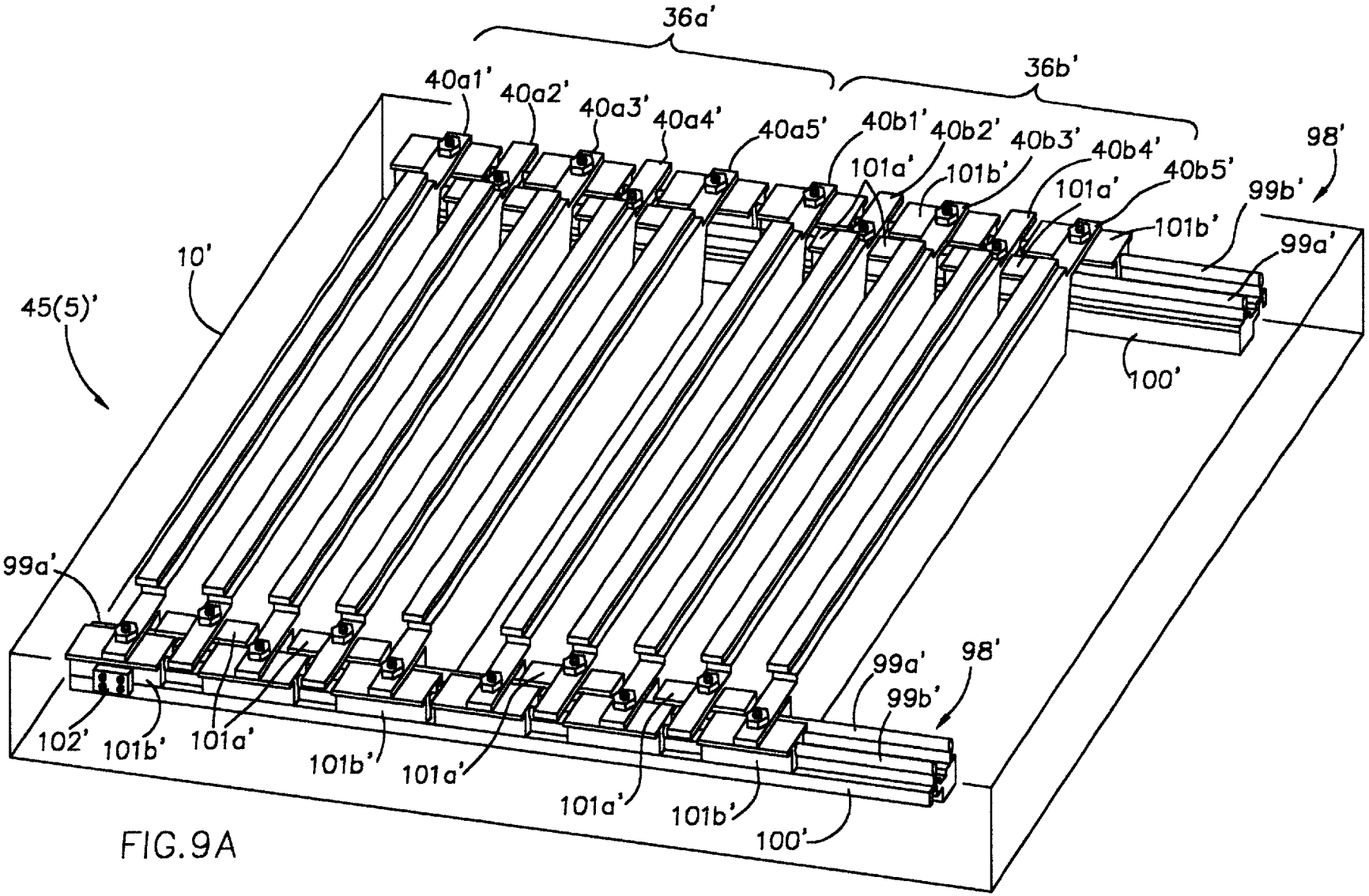
FIGS. 9A–9B are top and bottom perspective views, respectively, of another embodiment of a variable frequency foil (VFF) box according to the invention assembled with a second set of foils, showing the leading and trailing foil beams of each set mounted on linear rails, and utilizing pantograph assemblies, right-angle gearboxes and lead screw assemblies to move the foil support beams.
Figure 9B:
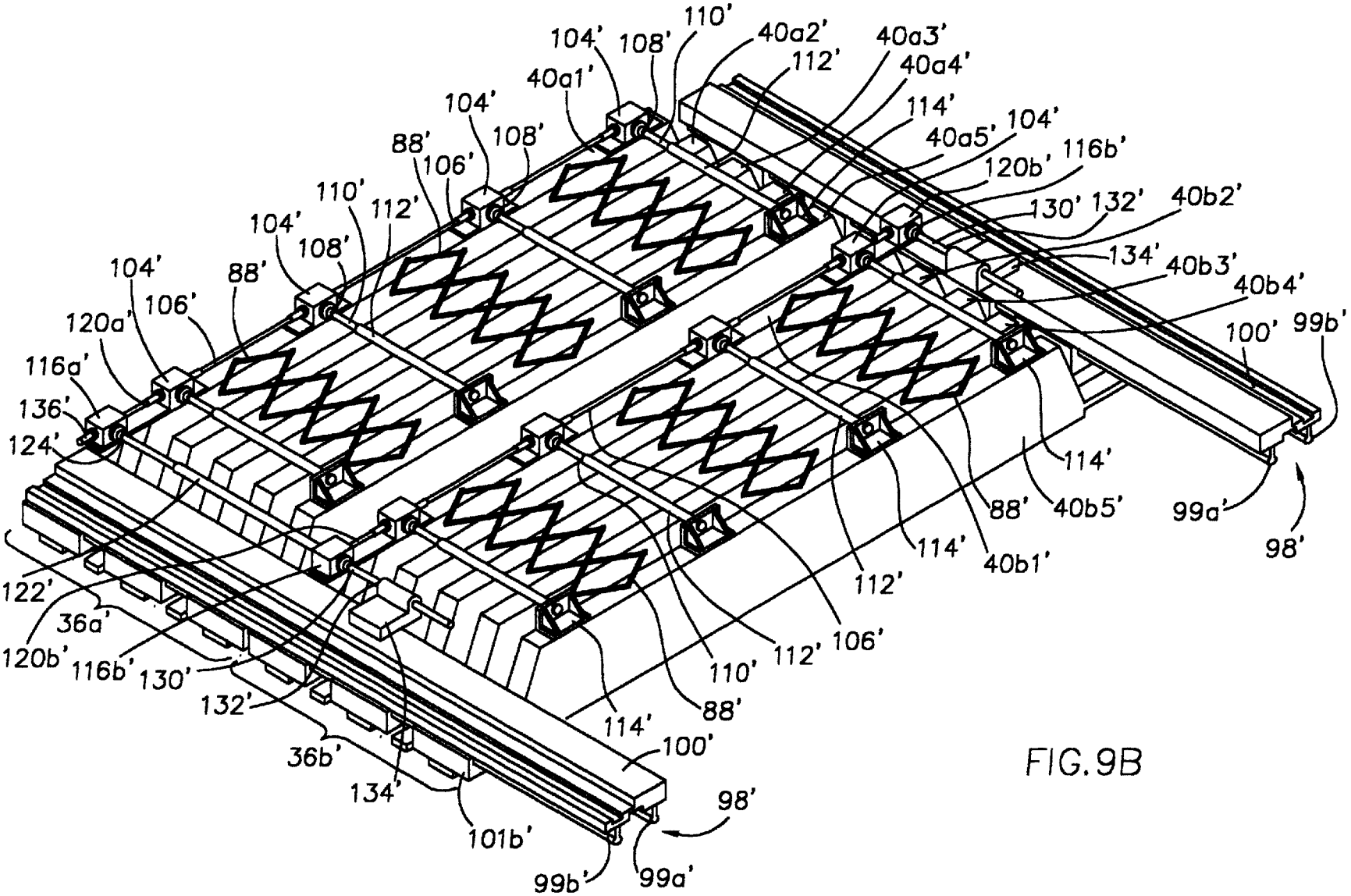

Another embodiment of a variable frequency foil box according to the invention, illustrated as VFF sets 36*a*', 36*b*', is depicted in FIGS. 9A–9B. As shown, a linear rail system 98' for supporting the foil beams can be used in place of a conventional "box" type structure (e.g., FIG. 6). The linear rail system 98' can be affixed to the frame 100' of a Fourdrinier table 10' (shown in phantom). Preferably, as shown, the rail system 98' comprises two parallel rails, pairs of rails, an inner rail pair 99*a*' and an outer rail pair 99*b*'. The foil beams can be mounted on the rail pairs 99*a*', 99*b*' by means of linear bearings 101*a*', 101*b*'. The foil beams are preferably mounted on the rails 99*a*', 99*b*' in an offset or alternating manner, such that one bearing 101*a*' (and beam) is mounted on the inner rail pair 99*a*' and the adjacent or following bearing 101*b*' (and beam) is mounted on the outer rail pair 99*b*'. By offsetting or alternating the placement of the linear bearings 101*a*', 101*b*' of adjacent foil beams on the inner and outer rail pairs 99*a*', 99*b*', the beams can be moved relatively close together. Additionally, in this configuration, the distance that the leading support beam 40*b*1' of the second (trailing) foil beam set 36*b*' can travel forward is increased, thus yielding application over a broader range of machine speeds and table frequencies than with a conventional box-type structure where the end of the box limits how far the leading foil beam 40*b*1' can travel forward.

As shown in FIG. 9B, the two foil beam sets 36*a*', 36*b*', totaling ten (10) beams are illustrated as being interconnected utilizing an actuating mechanism 45(5)' comprising a telescoping assembly (122') and pantograph assemblies 88', although another of the actuating mechanisms and methods described herein can be utilized to accomplish equidistant spacing of the foils beams 40*a*1'–40*a*5', 40*b*1'–40*b*5', and the foil beam sets 36*a*', 36*b*'.

As illustrated, each of the foil beam sets 36*a*', 36*b*', comprise a leading foil beam 40*a*1', 40*b*1', three trailing intermediate foil beams 40*a*2'–40*a*4', 40*b*2'–40*b*4', and a trailing end foil beam 40*a*5', 40*b*5'. In the first foil beam set 36*a*', the leading foil support beam 40*a*1' is affixed on the rail by a mounting (bracket) device 102'. An actuating mechanism 45(1)'–45(5)' according to the invention, and also subsequently described mechanism 45(6)', can be used to move and space apart the intermediate foil support beams 40*a*2'–40*a*4', and the trailing support beam 40*a*5' of the first beam set 36*a*' at a distance X relative to the leading support beam 40*a*1'. In the second foil beam set 36*b*', the leading support beam 40*b*1' is not affixed to the rail and is slideable along the rail. The actuating mechanism of the invention that is utilized, functions to move the (second) leading support beam 40*b*1' at an integer multiple of X distance (1X, 2X, 3X, etc.) relative to the preceding trailing support beam 40*a*5' of the first foil beam set 36*a*'. The intermediate foil support beam 40*b*2'–40*b*4', and the trailing support beams 40*b*5' of the second foil beam set 41*b*' are moved and spaced apart at a distance X relative to the (second) leading support beam 40*b*1'.

Referring again to FIG. 9B, at least two right-angle gearboxes 104' (illustrated as four gear boxes) are attached to the leading foil support beam 40*a*1', 40*b*1' of each foil set 36*a*', 36*b*'. The gearboxes 104' are connected to each other via connecting shafts 106' to provide uniform rotary motion of the output shafts 108'. Connected to each gearbox 104' is a lead screw 110', preferably having 6 threads per inch (6-pitch screw). Each lead screw 110' is engaged into a mating nut 112', which is in turn attached to the trailing support beam 40*a*5', 40*b*5' via a mounting (bracket) assembly 114' that anchors the mating nut 112' and prevents rotation. An additional right-angle (outboard) gearbox 116*a*', 116*b*' is mounted near the end of each of the leading support beams 40*a*1', 40*b*1'. The outboard gearbox 116*a*', 116*b*' is connected to the adjacent gearbox 104' via a connecting (output) shaft 120*a*'.

The output shaft 124' of the outboard gearbox 116*a*' is connected to a telescoping spline shaft assembly 122', which is in turn attached to the input shaft (not shown) of the outboard gearbox 116*b*' attached to the (second) leading support beam 40*b*1'. This assembly connects the two foil sets 36*a*, 36*b*' together. The outboard gearbox 116*b*' on the (second) leading support beam 40*b*1' is connected via connecting output shaft 120*b*' to the adjacent gearbox 104', by shafts 106' to the remaining gearboxes 104', and by output shaft 120*b*' to another outboard gearbox 116*b*' mounted at the opposite end of the leading support beam 40*b*1', to control the foils of the second foil set 36*b*'.

The secondary output shafts (not shown) of the outboard gear boxes 116*b*', 116*b*', are coupled to screws 130', preferably having 4 threads per inch (4-pitch screws). The screws 130' are engaged into mating nuts 132' that are mounted to the rigid machine frame 100' via mounting brackets 134'.

To adjust the foil box assembly, the input shaft 136' on the outboard gearbox 116*a*' of the (first) leading support beam 40*a*1' is rotated. This, in turn, rotates all of the gearbox output shafts (and connected screws and shafts) at a 1:1 ratio.

As the assembly in FIGS. 9A–9B is illustrated as having five (5) foils per foil set 36*a*', 36*b*', there exists four (4) interfoil spaces at a distance (X). The interset space between the first foil set 36*a*' and the second foil set 36*b*' is twice (2X) the standard distance (X) between adjacent foils within each of the sets. During adjustment of the frequency of the table, it is preferred that the (first) leading foil support beam 40*a*1' of the first foil set 41*a*' is moved 1.5 times (1.5X) the distance that the trailing support beam 40*a*5' of the first foil set 41*a*' is moved. To insure this relationship, it is preferred that a 6-pitch screw is used within the foil sets 41*a*', 41*b*', and a 4-pitch screw is used between the foil sets 41*a*', 41*b*'.

Figure 10:
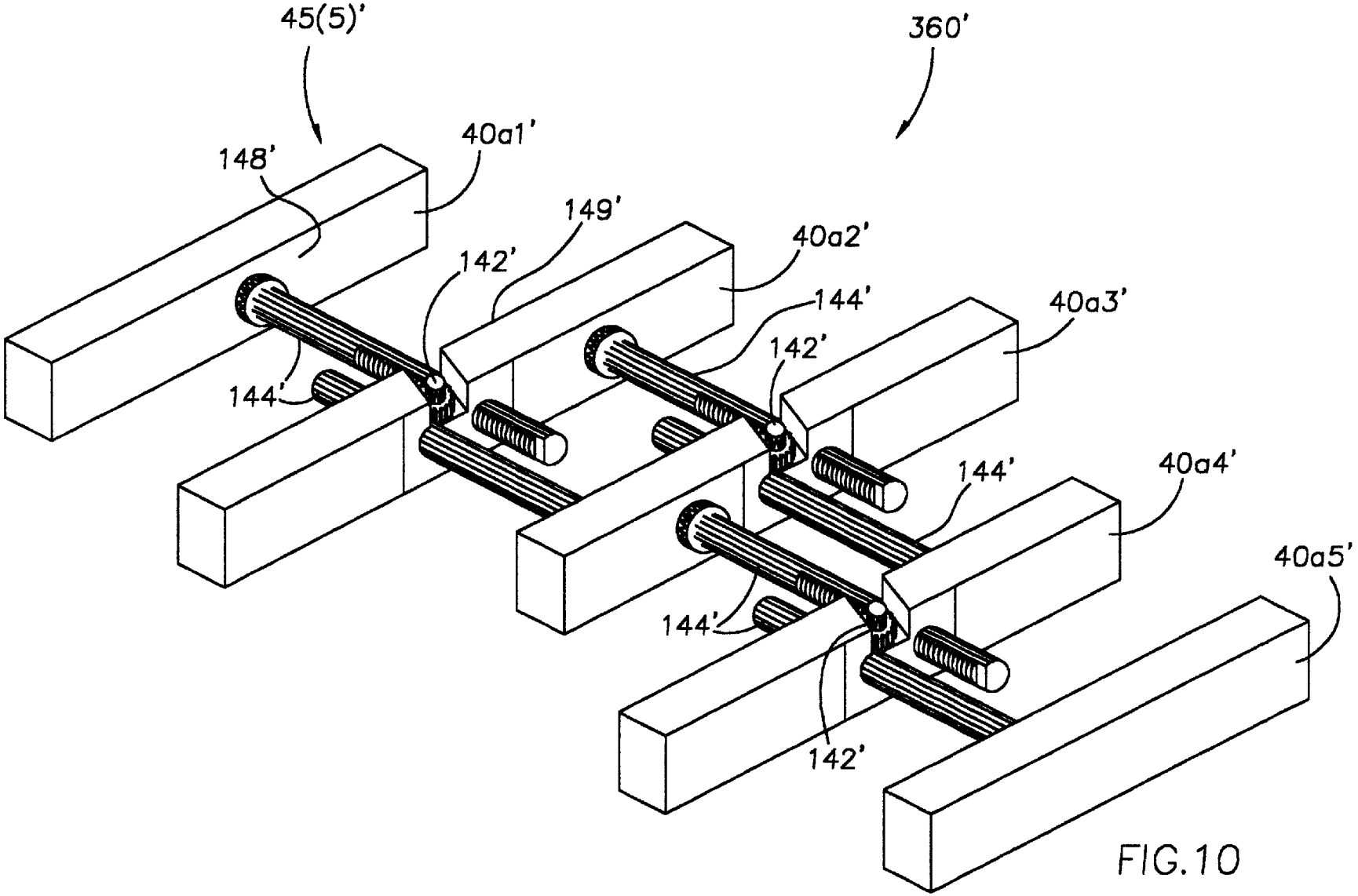
FIG. 10 is another embodiment of a variable frequency foil box of the invention illustrating a rack and pinion gearing mechanism that can be utilized to establish and maintain equidistant spacing between adjacent foil beams.

As shown in FIG. 10, in yet another embodiment of a variable frequency foil box according to the invention, illustrated as foil set 36*a*', opposing rack and pinion gear sets are utilized as an actuating mechanism 45(6)' to accomplish equidistant spacing of foil support beams 40*a*1'–40*a*5', and the foil sets (not shown). The actuating mechanism 45(5)' comprises at least two pinion gears 142' pivotally mounted within the intermediate foil support beams 40*a*2'–40*a*4'. The ends of the rack gears 144' that engage the pinion gears 142' are rigidly attached to the opposing surfaces of the adjacent support beams, for example, as shown with regard to the attachment of the rack gear 144' to surface 148' of the foil beam 40*a*1' and the opposing surface 149' of the foil beam 40*a*2'. This design insures that the spacing between the foil support beams 40*a*1'–40*a*5' remains substantially equidistant throughout the range of motion. The actuating mechanism 45(6)' can be utilized in place of the pantograph mechanism 88' described and illustrated with reference to FIG. 9B.

In the use of the actuating mechanism 45(5)', the positions of the intermediate foil beams 40*a*2'–40*a*4' and the trailing foil beam 40*a*5' can be adjusted by the use of at least two linear actuating (lead) screw assemblies (72') (not shown) similar to that depicted and described with reference to FIGS. 7 and 8A, that are connected in parallel to the foil beams and by a common actuator (73') comprising a drive shaft (not shown). As the actuating screw assemblies (72') move the trailing foil beam 40*a*5', the rack and pinion gear assembly mechanism 45(5)' draws the intermediate foil beams 40*a*2'–40*a*4', which are moved proportionally with the trailing foil beam 40*a*5'. The individual foil beams 40*a*1'–40*a*5' are preferably supported by at least two linear bearings (e.g., linear pillow blocks), for example, as shown and described with reference to FIGS. 6 and 8A (68'), that are supported by shafts (70') oriented perpendicular to the foil support beams 40*a*1'–40*a*5' to insure the lateral alignment of the beams in the machine and to control lateral and vertical movement.

The aforementioned mechanisms and methods can be utilized in any combination to construct variable frequency "boxes", foil sets and/or entire variable frequency gravity tables. The variable frequency box of the invention has numerous applications where paper machines are scheduled to run a variety of papers at varying speeds and stock consistencies. Examples include, but are not limited to, fine paper manufacturers, publication papers, liner board, security papers, and the like.

The mechanisms 45(1)'–45(5)' of the invention described herein can be readily combined with other known assemblies to alter the angle of each individual foil blade and/or raise or lower each foil blade into and out of contact with the Fourdrinier wire.

The described foil beam assemblies operate in an environment prone to contamination of the working parts. It is understood that the parts and mechanism described herein can be sealed or shielded during operation according to conventional methods to inhibit such contamination.

The invention has been described by reference to detailed examples and methodologies. These examples are not meant to limit the scope of the invention. It should be understood that variations and modifications may be made while remaining within the spirit and scope of the invention, and the invention is not to be construed as limited to the specific embodiments shown in the drawings. The disclosures of the cited references throughout the application are incorporated by reference herein.

What is claimed is:

1. A foil beam assembly, comprising:

at least a first and a second foil beam set, each foil beam set comprising a leading foil beam, a trailing foil beam, and at least one intermediate foil beam disposed therebetween; the foil beams having a pitch distance therebetween, and the foil beam sets being spaced apart by a distance therebetween; and an actuating mechanism connected to each of the foil beams and to the first and second foil beam set, and operable to laterally move the foil beams to alter the pitch distance between the foil beams such that the foil beams are spaced apart by a standard interval, and to laterally move at least one of the foil beam sets to alter the distance therebetween such that the foil beam sets are spaced apart by an integer multiple of the standard interval.

2. The foil beam assembly according claim 1, wherein the foil beam sets have a combined frequency adjustable by the lateral movement of the foil beams by the lateral movement of the at least one foil beam set, or both, by the mechanism.

3. The foil beam assembly according to claim 1, wherein at least the leading foil beam and the trailing foil beam are mounted on a support comprising a box shaped frame.

4. The foil beam assembly according to claim 1, wherein at least the leading foil beam and the trailing foil beam are mounted on a support comprising rails.

5. A foil beam assembly, comprising:

first and second foil beam sets, each foil beam set comprising a leading foil beam, a trailing foil beam, and at least one intermediate foil beam interposed therebetween; and an actuating mechanism operable to laterally move the trailing foil beam and the intermediate foil beams provide a pitch distance X between each foil beam, and to move the leading foil beam of the second foil beam set relative to the trailing foil beam of the first foil beam set, a distance that is integer multiple of the pitch distance X.

6. A foil beam assembly, comprising:

at least first and second foil beam sets, each foil beam set comprising at least two foil beams mounted on a support, and an actuating mechanism connecting the at least two foil beams and the foil beam sets; the actuating mechanism operable to alter pitch distance the foil beams whereby the foil beams are maintained at a substantially equal distance relative to each other, and the foil beam sets are spaced apart at an integer multiple of the distance between foil beams.

7. A foil beam assembly, comprising:

at least first and second foil beam sets, each foil beam set comprising at least a first and second foil beam mounted on a support, and an actuating mechanism connecting the foil beams and the foil beams sets; the actuating mechanism operable to laterally move and space apart the foil beams by a standard interval, and to laterally move at least one of the foil beam sets to space apart the foil beam sets by an integer multiple of the standard interval.

8. The foil beam assembly according to claim 7, wherein the actuating mechanism comprises:

a mating screw and nut assembly affixed to the first foil beam and an adjacent second foil beam, and in rotatable contact with a gear mounted on a shaft; whereby rotating the shaft causes lateral movement of at least the second foil beam to alter the pitch distance between the first and second foil beams.

9. The foil beam assembly according to claim 8, wherein the mating screw and nut assembly comprises:

a first screw member having an outer threaded surface, and affixed to a side of the first foil beam;

a stationary first nut member having an inner threaded surface, and member affixed to a side of the second foil beam;

a rotatable second nut member having an inner and an outer threaded surface, the inner surface of the rotatable second nut member engaged onto the outer threaded surface of the first screw member, and the outer surface of the rotatable second nut member engaged within the inner threaded surface of the stationary first nut member; and rotatable gear mounted onto the outer threaded surface of the rotatable second nut member' whereby rotating the shaft in a first direction causes the gear mounted on the rotatable second nut member to turn in a counter direction to engage the rotatable second nut member with the first screw member and the second stationary nut member to laterally move at least the second foil beam.

10. The foil beam assembly according to claim 7, wherein the actuating mechanism comprises a hydraulic or pneumatic device mounted on the first and second foil beams and operable to laterally move at least the second foil beam to alter the pitch distance between the first and second foil becomes.

11. The foil beam assembly according to claim 10, wherein the actuating mechanism further comprises an actuator connected to the hydraulic or pneumatic device, and operable to actuate the hydraulic or pneumatic device.

12. The foil beam assembly according to claim 11, wherein the actuator comprises a drive motor, a pneumatic pump, a hydraulic pump, an air compressor, or a combination thereof.

13. The foil beam assembly according to claim 10, further comprising at least one linear bearing supported by a shaft, the linear bearing attached to at least one foil beam and oriented perpendicular to the foil beams to maintain lateral alignment to the foil beams relative to each other.

14. The foil beam assembly according to claim 7, wherein the mechanism comprises:

a hydraulic or pneumatic cylinder mounted on at least the second foil beam and comprising a mechanism for communicating the position of the second foil beam to a controller and receiving a signal from the controller to actuate the cylinder to laterally move the second foil beam to alter the pitch distance between the first and second foil beam.

15. The foil beam assembly according to claim 14, wherein the communicating mechanism comprises a transducer.

16. The foil beam assembly according to claim 7, wherein the actuating mechanism comprises:

a first actuating screw and nut assembly affixed to the second foil beam and oriented perpendicular to the foil beams, the actuating screw connected to an actuating device operable to move the actuating screw to laterally move the second foil beam to alter the pitch distance between the first and second foil beams.

17. The foil beam assembly according to claim 16, wherein the actuating device comprises a worm gear assembly, and the gear is affixed to the actuating screw and the worm is mounted on a drive shaft.

18. The foil beam assembly according to claim 17, wherein a second actuating screw and nut assembly is affixed to the first foil beam, the second actuating screw connected to the actuating device.

19. The foil beam assembly according to claim 18, wherein the worm:gear ratio for the first actuating screw and nut assembly is about 10:1, and the worm:gear ratio for the second actuating screw and nut assembly is about 10:2.

20. The foil beam assembly according to claim 19, further comprising a third foil beam, and the mechanism further comprising a third actuating screw and nut assembly affixed to the third foil beam, and the actuating screw is connected to the actuating device, wherein the worm:gear ratio for the third actuating screw and nut assembly is about 10:3.

21. The foil beam assembly according to claim 16, further comprising at least one linear bearing supported by a shaft, the linear attached to at least one foil beam and oriented perpendicular to the foil beams to maintain lateral alignment of the foil beams relative to each other.

22. The foil beam assembly according to claim 7, wherein the actuating mechanism comprises:

first and second nut members mounted on a surface of the first and second foil beams; and first and second actuating screw members engaged respectively through the first and second nut members and extending perpendicular to the foil beams; the first and second actuating screw members connected to an actuator operable to move the actuating screw members to laterally move at least the second foil beam relative to the first foil beam to alter the pitch distance therebetween.

23. The foil beam assembly according to claim 22, wherein the actuator comprises first and second worm gear assemblies connected, respectively, to the first and second actuating screw members, with the worm gear assemblies mounted on a drive shaft.

24. The foil beam assembly according to claim 7, wherein the mechanism comprises:

a pantograph assembly connected to the first and second foil beams;

wherein extension and retraction of the pantograph moves at least the second foil beam relative to the first foil beam to alter the pitch distance therebetween.

25. The foil beam assembly according to claim 24, wherein the first and second foil beams are connected at center pivots of the pantograph assembly.

26. The foil beam assembly according to claim 24, wherein each of the foil beam sets comprises a leading foil beam, a trailing foil beam, and at least one intermediate foil beam positioned therebetween; and the mechanism comprises a pantograph assembly connected to each foil beam; and an actuator connected to the leading foil beam and the trailing foil beam and operable to move the trailing foil beam, and the pantograph assembly is operable to move the intermediate foil beam proportionally to the trailing foil beam.

27. The foil beam assembly according to claim 7, wherein each of the foil beam sets comprises a leading foil beam, a trailing foil beam, and at least one intermediate foil beam disposed therebetween, and the mechanism comprises a pantograph assembly connected to each of the foil beams; and an actuator connected to an end of the pantograph assembly and operable to cause the pantograph assembly to move whereby the foil beams are laterally moved relative to each other to alter the distance therebetween.

28. The foil beam assembly according to claim 7, wherein the actuating mechanism comprises a telescoping shaft assembly.

29. The foil beam assembly according to claim 28, wherein the foil beam set comprises a leading foil beam, a trailing foil beam and at least one intermediate foil beam, and the telescope shaft assembly is connected to the first and second foil beam sets to distribute mechanical power to the second foil set.

30. The foil beam assembly according to claim 29, wherein the telescoping shaft assembly is connected to the leading foil beams of the first and second foil beam sets.

31. The foil beam assembly according to claim 30, wherein the telescoping shaft assembly is operable to laterally move the leading foil beam of the second foil beam set relative to the trailing foil beam of the first foil beam set to alter a distance between the foil beam sets.

32. The foil beam assembly according to claim 7, wherein each of the foil beam sets comprises a leading foil beam and a trailing foil beam; and the actuating mechanism is connected to the leading foil beams of the first and second foil beam sets, and operable to move the leading foil beam of the second foil beam set relative to the trailing foil of the first foil beam set alter a distance between the foil beam sets.

33. The foil beam assembly according to claim 32, wherein the actuating mechanism comprises a telescoping shaft assembly connecting the leading foil beams of the first and second foil beam sets.

34. The foil beam assembly according to claim 7, wherein the actuating mechanism comprises a rack gear that engages a pinion gear.

35. The foil beam assembly according to claim 34, wherein each of the foil beam sets comprises a leading foil beam, a trailing foil beam, and at least one intermediate foil beam interposed therebetween; wherein the pinion gear is mounted within the intermediate foil beam, and the rack gears comprise first and second ends, the first end of a first rack gear attached to the leading foil beam, and the second end of the first rack gear engaging the pinion gear; and the first end of the second rack gear engaging the pinion gear and the second end of the rack gear attached to the trailing foil beam.

36. The foil assembly according to claim 35, further comprising an actuator attached to the leading foil beam and the trailing foil beam, and operable to laterally move the trailing foil beam relative to the leading foil beam.

37. The foil beam assembly according to claim 36, wherein the rack and pinion gears assembly are operable to laterally move the intermediate foil beam proportionally with the trailing foil beam.

38. The foil beam assembly according to claim 7, wherein the foil beams are supported by a linear bearing mounted on a shaft oriented perpendicular to the foil beams.

39. The foil beam assembly according to claim 7, wherein the foil beams are mounted on a support comprising a box structure.

40. The foil beam assembly according to claim 7, wherein the foil beams are mounted on a support comprising rails.

41. The foil beam assembly according to claim 40, wherein the support comprises an inner pair of rails and an outer pair of rails, and the first foil beam is mounted on one of the pair of rails and the second foil beam is mounted on the other of the pair of rails.

42. The foil beam assembly according to claim 41, wherein the first foil beam of the first foil set is affixed to the rails in a stationary position, and the first foil beam of the second foil set and the second foil beams of the first and second sets are slideably mounted on the rails.

43. A foil beam assembly, comprising:

first and second foil beam sets, each foil beam set comprising at least two foil beams supported on a rail system; and a mechanism operable to move at least one foil beam of the first foil beam set to alter a pitch distance between two foil beams of the first foil beam set by a distance X, and to move a foil beam of the second foil beam set relative to the first foil beam set to alter an interest distance between the first and second foil beam sets by an integer multiple of distance X.

44. The foil beam assembly according to claim 43, wherein the rail system is affixed to a frame of a paper making machine.

45. The foil beam assembly according to claim 43, wherein the mechanism is operable to move a foil beam of the second foil beam set by a distance X from a second foil beam of the second foil beam set.

46. In an apparatus comprising a two or more foil beam sets, each foil beam set comprising a plurality of foil beams mounted on a support, a mechanism to alter the pitch distance between individual foil beams of the foil beam set whereby the individual foil beams are maintained at a distance X relative to each other, and to alter the distance between adjacent foil beam sets to maintain the distance as an integer multiple of the distance X of the foil beams.

47. In a foil beam assembly comprising a two or more foil beam sets with each set comprising a plurality of foil beams mounted on a support, a mechanism for adjusting the frequency of the foil beam assembly, the mechanism connected to the foil beams and operating to alter pitch distance between individual foil beams of the set whereby the individual foil beams are maintained substantially equally spaced relative to each other, and the mechanism connected to the foil beam sets and operating to alter the distance between the sets to an interest distance as an integer multiple of the foil spacing.

48. A method of varying the frequency of a foil beam set, comprising the steps of:

providing at least a first and second foil beam set, each set comprising two or more foil beams mounted on a support structure, and an actuating mechanism interconnecting the foil beams and the foil beam sets, the actuating mechanism structured to laterally move the foil beams relative to each other and to laterally move the foil beam sets relative to each other; and actuating the actuating mechanism to laterally move the foil beams to alter the distance therebetween and maintain the foil beams at a distance X relative to each other, and to laterally move the foil beam sets relative to each other to a distance as an integer multiple of the distance X.

* * * * *

UNITED STATES PATENT AND TRADEMARK OFFICE

CERTIFICATE OF CORRECTION

PATENT NO. : 6,471,829 B2
DATED : October 29, 2002
INVENTOR(S) : Frawley, Jr. et al.

It is certified that error appears in the above-identified patent and that said Letters Patent is hereby corrected as shown below:

Title page,
Item [56], References Cited, OTHER PUBLICATIONS, reference "Paper Trade Associates" replace "http;//paper-tradeassoc.com/p506.htm" with -- http://papertradeassoc.com/p506.htm --.
Reference "GMS Ball Co. Ltd.," replace "http://www.gms-ball.co.uk," with -- http://www.gmsball.co.uk --.
Reference "ActionJac™" replace "http://www.nookin-dustries.com/productsummary/actionjac_gear.cfm," with -- http://www.nookindustries.com/productsummary/actionjac_gear.cfm --.
2nd reference listing "ActionJac™" replace "http://www.nook-industries.com/productsummary/actionjac_cylinder.cfm," with -- http://www.nookindustries.com/productsummary/actionjac_cylinder.cfm --.

Columns 7 and 8,
Table 1, at the intersection of "3900.00 ft/min" and "4.25 foil pitch" replace "185.53" with -- 183.53 --.
Table 1, at the intersection of "2200.00 ft/min" and "5.75 foil pitch" replace "76.62" with -- 76.52 --.

Columns 9 and 10,
Table 1, at the intersection of "1100.00 ft/min" and "9.25 foil pitch" replace "23.76" with -- 23.78 --.

Column 11,
Line 57, replace "40 *a*l' - O*a*5'" with -- 40*a*l'-40a5' --.

Column 12,
Line 15, replace "beams assemblies" with -- beams 40*a*'-40*a*5'. Preferably, each foil beam 40*a*l'-40*a*5' comprises at least two nut/actuating screw assemblies --.
Line 30, replace "78b," with -- 78b, --.

Column 13,
Line 7, replace "40*a*2' '*a*4'," with -- 40*a*2'-40*a*4', --.

UNITED STATES PATENT AND TRADEMARK OFFICE

CERTIFICATE OF CORRECTION

PATENT NO. : 6,471,829 B2
DATED : October 29, 2002
INVENTOR(S) : Frawley, Jr. et al.

It is certified that error appears in the above-identified patent and that said Letters Patent is hereby corrected as shown below:

Column 16,
Line 1, replace “according” with -- according to --.
Line 7, replace “mounted on” with -- mounted in --.
Line 22, replace “is integer” with -- is an integer --.
Line 28, replace “distance the” with -- distance between the --.
Line 37, replace “beam sets” with -- beam set --.
Line 66, replace “rotatable” with -- a rotatable --.
Line 67, replace “member” with -- member; --.

Column 17,
Line 12, replace “becomes.” with -- beams. --.
Line 33, replace “beam.” with -- beams. --.

Column 18,
Line 29, replace “Claim 24,” with -- Claim 7, --.

Column 20,
Lines 5-6 and 35, replace “interest distance” with -- interset distance --.

Signed and Sealed this

Second Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,471,829 B2
DATED : October 29, 2002
INVENTOR(S) : Frawley, Jr. et al.

It is certified that error appears in the above-identified patent and that said Letters Patent is hereby corrected as shown below:

Column 12,
Line 30, replace "assembly 78b" with -- assembly 78b' --.

Signed and Sealed this

Sixteenth Day of December, 2003

JAMES E. ROGAN
*Director of the United States Patent and Trademark Office*